US009619957B2

(12) United States Patent
Dobbins et al.

(10) Patent No.: US 9,619,957 B2
(45) Date of Patent: Apr. 11, 2017

(54) COIN AND BILL DISPENSING SAFE

(71) Applicant: Ellenby Technologies, Inc, Woodbury Heights, NJ (US)

(72) Inventors: Bob M. Dobbins, Villanova, PA (US); Philip Rene Reger, New Providence, PA (US); Scott Barnes, Wenonah, NJ (US); Thomas Carullo, Marlton, NJ (US)

(73) Assignee: ELLENBY TECHNOLOGIES, INC., Woodbury Heights, NJ (US)

( * ) Notice: Subject to any disclaimer, the term of this patent is extended or adjusted under 35 U.S.C. 154(b) by 0 days.

(21) Appl. No.: 14/824,926

(22) Filed: Aug. 12, 2015

(65) Prior Publication Data

US 2016/0035173 A1 Feb. 4, 2016

Related U.S. Application Data

(63) Continuation of application No. 14/293,431, filed on Jun. 2, 2014, now Pat. No. 9,142,079, which is a continuation of application No. 13/753,119, filed on Jan. 29, 2013, now Pat. No. 8,770,372.

(60) Provisional application No. 61/594,445, filed on Feb. 3, 2012.

(51) Int. Cl.

| | |
|---|---|
| ***G07F 9/10*** | (2006.01) |
| ***G07D 11/00*** | (2006.01) |
| ***G07D 1/00*** | (2006.01) |
| ***G07D 1/02*** | (2006.01) |
| ***G07D 7/00*** | (2016.01) |

(52) U.S. Cl.

CPC ..... *G07D 11/0069* (2013.01); *G07D 1/00* (2013.01); *G07D 1/02* (2013.01); *G07D 7/00* (2013.01); *G07D 11/00* (2013.01); *G07D 11/0066* (2013.01); *G07D 11/0087* (2013.01); *G07F 9/10* (2013.01)

(58) Field of Classification Search

CPC .. G07D 1/02; G07D 7/00; G07D 9/10; G07D 11/0066; G07D 11/0069; G07D 11/0087; G07F 9/10

See application file for complete search history.

(56) References Cited

U.S. PATENT DOCUMENTS

| | | | | |
|---|---|---|---|---|
| 5,725,081 | A | 3/1998 | Meeker | |
| 5,883,371 | A | 3/1999 | Meeker | |
| 5,938,072 | A * | 8/1999 | Lamoureux | G07D 1/00 221/218 |
| 5,984,509 | A | 11/1999 | Scott | |
| 6,213,341 | B1 | 4/2001 | Keith | |

(Continued)

*Primary Examiner* — Mark Beauchaine

(74) *Attorney, Agent, or Firm* — Hultquist, PLLC; Peter H. Priest

(57) ABSTRACT

A readily reconfigurable cash dispensing system for providing change, such as coins of different values and bills or currency of different denominations needed by a retail store, grocery store, busy convenience store, or the like. A tray or trays for storing and delivering multiple rolls of coins or bills of a first value, as well as, a tray or trays for storing and delivering stacks of bills are described herein. A bill acceptor may be employed to accept bills used to purchase rolls of coins and stacks of bills, and a system controller can sense restocking and dispensing events to maintain an accurate inventory of cash in the bill acceptor, as well as, the total cash stored in the form of coin rolls or rolls bills, as well as, bill stacks.

16 Claims, 26 Drawing Sheets

(56) References Cited

U.S. PATENT DOCUMENTS

| | | | | |
|---|---|---|---|---|
| 7,111,754 | B1 | 9/2006 | Siemens | |
| 7,340,415 | B1 * | 3/2008 | Gasper | G06Q 20/1085 705/43 |
| 7,591,361 | B2 * | 9/2009 | McGunn | G07D 1/00 194/216 |
| 7,870,942 | B2 * | 1/2011 | Imai | G07D 1/02 194/217 |
| 2004/0003980 | A1 * | 1/2004 | Hallowell | B65B 27/08 194/206 |
| 2010/0070074 | A1 * | 3/2010 | Duncan | G07F 11/60 700/242 |
| 2010/0237091 | A1 * | 9/2010 | Garson | G07F 11/16 221/226 |

* cited by examiner

COIN AND BILL DISPENSING SAFE

This application is a continuation of U.S. application Ser. No. 14/293,431 filed on Jun. 2, 2014 which issued as U.S. Pat. No. 9,142,079 which is a continuation of U.S. application Ser. No. 13/753,119 filed on Jan. 29, 2013 which issued as U.S. Pat. No. 8,770,372 which claims the benefit of U.S. Provisional Patent Application Ser. No. 61/594,445 entitled "Coin and Bill Dispensing Safe" filed Feb. 3, 2012 which are hereby incorporated by reference in their entirety.

FIELD OF INVENTION

The current invention relates generally to the tracking and dispensing of quantities of money for change, such as rolls of coins, stacks of bills, or bills rolled up in cylinders or dispensed in tubes. More particularly, a cash dispensing unit is described which can be used in combination with one or more cash acceptors to advantageously provide a closed loop money accounting system.

BACKGROUND

There are a number of products on the market which will dispense rolls of coins or quantities of bills under direct or remote control. These products may contain bill or coin acceptors and may dispense the coins or bills in response to coins and bills being accepted as a way of providing change for supporting a retail or similar operation. In response to security concerns, these products are usually housed in a secure Class B safe enclosure. In many cases, tubes are used to store rolls of coins or a number of bills rolled into a tube. In some cases, bills will be dispensed from bill dispensers which dispense bills from a holding cassette in response to control electronics.

The dispensing safe may be the responsibility of someone other than the person in the facility, such as a store, that may be loading the machine. Often times, an armored car carrier company or an offsite facility owner is responsible for the money in the safe. Agents or employees used to fill and collect money from the machine will have full access. Typically, there is nothing to insure the dispensers are properly loaded other than the reliability of such personnel.

The typical products currently available suffer from a number of deficiencies limiting their usefulness. In particular, these products suffer from high cost. They have no or limited knowledge of the actual value of money in the safe. They have limited flexibility to adapt to the amounts of coins and bills optimally required for a given site, or the ability to adapt to substantially different seasonal requirements, and have high service requirements.

It is becoming increasingly important to ensure the amount of money in an accepting and dispensing safe be known absolutely without being dependent on a route or service person counting correctly or being honest. It is not unusual for an armored car carrier company to be responsible for the money in the secured accepting and dispensing safe. As an alternative, an owner of several locations, such as a number of convenience stores, may want to have adequate change on hand so employees do not lose valuable time going to a bank for change while having total knowledge and control of the money in the safe. Additionally, as space is often at a premium in retail outlets such as convenience stores and fast food restaurants, the size of the safe should be kept small while allowing the maximum flexibility for storing various coin and bill denominations and quantities.

An approach of one current technology can be seen in Meeker U.S. Pat. Nos. 5,725,081 and 5,883,371. This class of deposit and dispensing safes use a bill acceptor for accepting bills and a dispense mechanism for dispensing rolls of coins or bills. In these patents, each tube column of a plurality of columns is dispensed at the bottom of the column and dispenses to the front of a secure box. Thus, the size of the secure box must be sufficiently large to hold all the rolls of tubes on its face. This results in a very large and heavy product with limited capacity. Thus, the dispensing mechanism is substantially limited in the quantity of rolls of coins or bills it can hold as it requires the front face of the secure box to be large enough to hold all the desired columns of tubes. Additionally, the number of tubes in the dispenser is not known other than by counting them. This approach results in a significant security issue as the person loading the machine can count incorrectly, as a result of human error, or purposely misrepresent the number of tubes in the dispenser. Thus, an accurate accounting of the money in the secure housing is not possible. Additionally, there is no verification of the tubes being dispensed which further leads to frustration by the user and possible disputes between end users, store owners and parties loading the dispensers. Thus, the security of the system is subject to needless compromise. The amount of bills put in the tubes is also a subject of potential security issues as well, as someone has to manually count and stuff the tubes.

In a similar approach, Keith, in U.S. Pat. No. 6,213,341, also teaches a series of tube columns similar to those of Meeker, but adds a series of sensors in each column to "see" each of the tubes in the column. This allows the electronics to know how many tubes are in the unit, but does not know that the correct tube or even a filled tube is being used. This technology suffers from the ease with which the tube count can be fooled, and hence the value of the money in the unit derived therefrom. It also suffers from many of the other issues described above relative to the potential inaccuracies of the approaches of the Meeker patents.

Another approach is described by Scott in U.S. Pat. No. 5,984,509. Here, Scott teaches a preloaded cassette for holding rolls of coins. The rolls are dispensed employing a complicated electromechanical technique in an effort to dispense at high speeds. Additionally, Scott teaches the counting of rolls in each cassette to determine the value of money in the cassettes. This technology has a number of limitations including high cost, an assumed value by counting the space needed to house a number of rolls leaving the value of each roll suspect, and a very large secure box to house the dispensers. Additionally, there is little flexibility with respect to stocking the number of rolls of coins needed per location.

Another prior art technology employing coin hoppers is described by Lamoureux in U.S. Pat. No. 5,938,072 and similarly by Siemens in U.S. Pat. No. 7,111,754. These patents address the use of roll coin hoppers to house large numbers of rolls of coins. The rolls are routed to the bottom and dispensed one at a time. Both teach the use of a sensor to detect the dispensing of each roll of coins. These approaches suffer from high cost, large unit size, knowledge of what was dispensed, but not what remains in the machine, and limited flexibility to control the number of rolls of coins needed in a given location.

A further approach to roll coin dispensing is described by McGunn in U.S. Pat. No. 7,591,361. In this approach, a row of vertically standing tubes of currency are pushed forward via a pusher plate. The number of tubes is determined by the position of the pusher plate. This approach measures the position of a pusher plate and can easily be defeated by putting empty tubes, incorrect tubes, or spacers in with the other tubes in a given row. Also, as in other approaches, an accurate determination of the total value of the tubes is dependent on the correct tubes being placed in each row.

SUMMARY OF THE INVENTION

Among its several aspects, the present invention recognizes the many failings of approaches such as those described above, and recognizes a need in the industry for a cost effective, space efficient cash accepting and dispensing safe that is secure and capable of reporting the value of the money within. There is also a need for cash accepting and dispensing safes that can be flexibly configured to adjust the number and value of coins and bills to be housed in the safe to optimize the amount of money needed to meet the needs at each location while minimizing the inventory of money being stored.

Consequently, an objective of one aspect of the current invention is to provide a rolled coin and bill dispensing safe that allows for cash acceptance providing a closed loop pay for change system.

One objective of another aspect of the current invention is to provide a rolled coin dispensing safe system that can determine the value of coins in the safe.

Another objective of a further aspect of the current invention is to provide a bill dispensing safe system that can determine the value of bills in the safe.

Another objective of another aspect of the current invention is to provide an easily configurable rolled coin dispenser so the total number of coins and coin types can be adaptable unit to unit.

Yet, a further objective of one aspect of the current invention is to provide a rolled coin and bill dispenser that is easy to load, and which makes it easy to determine the proper location by denomination for each coin and bill type.

Still another objective of an aspect of the current invention is to provide an electronic dispensing safe with sensors to measure both the amount and value of rolled coins and stacked bills within.

Yet, another objective of an aspect of the current invention is to provide an electronic dispensing safe with sensors to measure the value of rolled coins or stacked bills being dispensed.

Another objective of one aspect of the current invention is to provide a rolled coin and stacked bill packing system which is encoded with the denomination of the currency enclosed and the value of the currency enclosed.

A further objective of an aspect of the current invention is to provide a rolled currency and stacked bill dispensing system that can be automatically configured to determine the type and amount of money housed in the system.

Another objective of an aspect of the current invention is to provide a low cost paper currency dispensing system.

Another objective of a further aspect of the current invention is to provide a bill dispensing system which is flexible relative to the quantity and denomination of bills to be dispensed at a time.

Yet, another objective of another aspect of the current invention is to provide a smart package for housing coins and bills which is low cost and has relevant data to the money so packaged.

A further objective of an aspect of the current invention is to provide a dynamically updated list of options for currency dispensing based on the current value of money deposited.

Yet, another objective of an aspect of the current invention is to provide a coin and bill dispensing system that minimizes the friction associated with moving a quantity of rolls or stacks of bills.

Another objective of one aspect of the current invention is to provide a dispensing system capable of dispensing multiple rolls of coins, rolls of bills, and stacks of bills simultaneously.

Yet another objective of one aspect of the current invention is to provide a dispensing system which dynamically optimizes the number of coins and bills dispensed at a time.

A further objective of an aspect of the current invention is to provide a user interface to allow easy selection choices that are dynamically displayed.

Another objective of one aspect of the current invention is to provide optical multiple color scanners to detect a large number of rolled coin or stacked bills selections with minimum coding.

A further objective of an aspect of the current invention is to provide a means for detecting locating positions for rolled coins and bill stacks to determine whether the expected rolls or stacks are present.

Yet, another objective of an aspect of the current invention is to provide a means for detecting the direction of motion of a tray of products.

An additional objective of a further aspect of the current invention is to provide an RFID system to identify the type and value of dispensed money.

Another objective of an additional aspect of the current invention is to provide an encrypted RFID communications system to avoid cheats.

Yet, a further objective of an aspect of the current invention is to sense the direction of motion of coins or bills to determine if they are being placed into the safe or removed from the safe.

It is a further objective of one aspect of the current invention to provide a dual tray cash dispensing system to provide high security.

Another objective of an aspect of the current invention is to determine the position of product trays and drawers to insure they are in the ready to vend position before moving product.

A further objective of a further aspect of the current invention is to be able to anticipate the number and value of rolls and stacks to be loaded into the machine and send alerts or alarms if the expected number and values are not so inserted.

Yet, another objective of one aspect of the current invention is to set a reload level for each coin or bill type and send alerts when these levels are met.

Another objective of an aspect of the current invention is to allow a fee to be determined and charged based on the amount of rolls and stacks vended.

A more complete understanding of the present invention, as well as further features and advantages of the invention, will be apparent from the following Detailed Description and the accompanying drawings. While a large number of potential advantages and objectives of the present invention are addressed above, this list is illustrative only. It will be recognized that systems and methods of the present invention as defined by the claims need not achieve all or even some of the above listed objects. Further, other advantages and objectives of the presently described invention may become apparent to those of ordinary skill in the art.

BRIEF DESCRIPTION OF DRAWINGS

FIGS. 10*a*-1 and 10*a*-2 (collectively 10*a*) are a schematic of the rolled coin detection receivers and transmitters used in a presently preferred embodiment;

FIGS. 14*a*-1, 14*a*-2 and 14*a*-3 (collectively 14*a*) are a schematic of the RFID bill stack detection receivers and transmitters used in a presently preferred embodiment;

DETAILED DESCRIPTION

Figure 1:
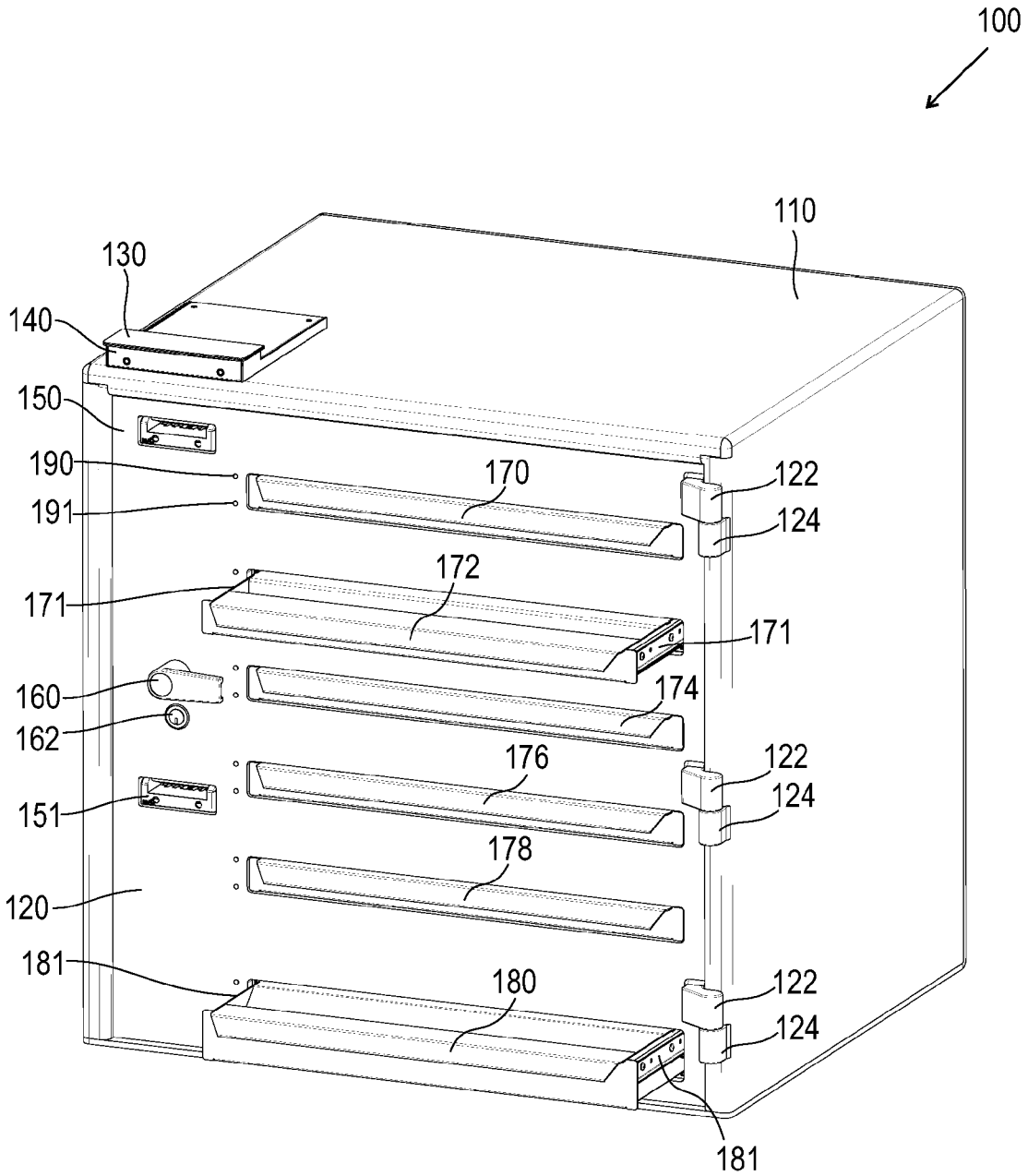
FIG. 1 is an isometric view of the cash accepting and dispensing safe in accordance with an embodiment of the present invention.

FIG. 1 shows an electronic coin and bill dispensing safe 100 including the safe housing 110 and safe door 120. In one configuration of safe 100, the safe housing 110 is made of approximately ¼ inch steel and the safe door 120 is made of ½ inch steel. The safe is preferably a Class B safe. Of course, other materials and gauges can be used as desired or required for a particular context or environment of use.

A user interface is provided through a keypad and display module 140 contained in user interface assembly 130. The material used for the assembly housing is also steel but of a much lighter gauge as a breach of the interface assembly does not allow access to the contents of the electronic safe 100. The keypad and display can both be of any suitably robust type. In a presently preferred embodiment, the keypad is a combination of a membrane overlay with conductive pads attached to a printed circuit board with conductive traces such that a depression of the membrane overlay shorts at least two conductive traces on the printed circuit board indicating the key depression. The display used in the presently preferred embodiment is an LCD display. The choice of keypad and display does not impact the current invention and any of many suitable choices will work. There is a growing trend to use a touch screen LCD or plasma display which is suitable, but currently expensive.

The safe housing 110 is assembled to the safe door 120 through the use of hinge sets 122, 124 including hinges 122 welded to the door 120 and hinges 124 welded to the safe housing 110 as shown in FIG. 1. Steel pins 125 (FIG. 2) are put between the hinges 122 and 124 which allow the door to pivot open and closed. In the presently preferred embodiment, three such hinge sets are used. Alternatively, other hinge sets can be used, such as continuous hinges.

The coin and bill dispensing safe can have many trays to store rolls of coins or stacks of bills as will be discussed later. Each tray is associated with a pull drawer to allow the user to have access to the coins or bills dispensed. FIG. 1 shows coin trays 170, 172, 174, 176 and 178. In the closed position, only the handle of the pull trays are visible from outside the safe. This is best seen in FIG. 1 relative to drawers 170, 174, 176 and 178 which are shown closed. Drawer 172 is shown in the opened or pulled out state. Each drawer has a pair of sliders 171 with one slider on each side that allow the drawer to be easily extended for access and then slide back to close the drawer. FIG. 1 also shows a bill drawer 180 in its open position exposing its sliders 181.

In a current implementation of invention, two indicator LEDs are used to communicate to the user when to open the drawer and which one to open. The top LED 190 will be green when the associated drawer is to be opened to remove the dispensed rolls of coins from a particular drawer. The bottom LED 191 will be red when the drawer is in its fully closed position. Each drawer has a set of LEDs as described above. Of course, other LED colors and indications can be used, such as a red LED lit when the drawer is not in its intended position.

The coin and bill dispensing safe 100 of the current invention also allows for one or more bill acceptors 150 and 151 to be used to accept bills. This arrangement of bill acceptors can be used to pay for the change directly or to allow the safe to be used as a drop safe in addition to its use as a dispensing safe. The bill acceptors used in a presently preferred embodiment are MEI SC66 series products. Alternate bill acceptors manufactured by MEI or other suppliers can be used. Alternatively, the coin and bill dispensing safe 100 can be operated without the requirement to accept bills at all. In this case, no bill acceptors are needed and an authorized person could dispense the needed coins or bills without "paying" for them.

As in any safe product, a secure lock mechanism is required. The preferred embodiment uses a lock handle 160 to open the door once a secure key lock 162 is opened with the unique key provided with that lock. The details of the lock mechanism will be discussed further below.

Figure 2:
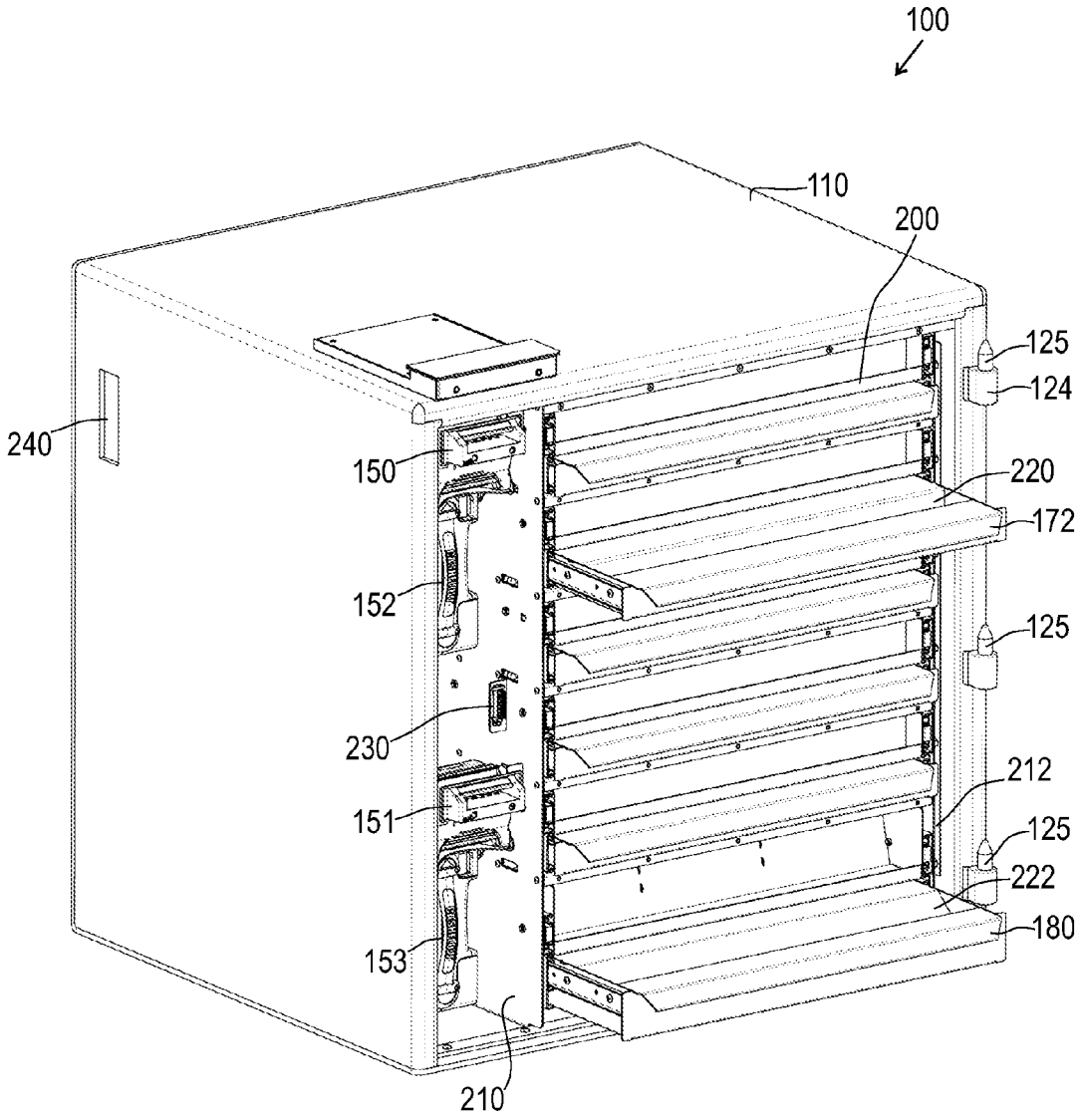
FIG. 2 is an isometric view of the cash accepting and dispensing safe of FIG. 1 without the door.

Referring to FIG. 2, the coin and bill dispensing safe is shown with the door 120 removed. Each of the open drawers 172 and 180 show a well 220 and 222 wherein lie the rolls of coins (or bills) or packs of bills to be dispensed from those drawers.

With the door 120 and hinges 122 removed, the pins 125 of hinges 124 are exposed. Pins 125 can be separate pieces or integral parts of the hinges 124 manufactured as a single machined part. The pin 125 used in a preferred embodiment is machined as part of the safe housing hinge 124. Note the bullet top profile of pin 125 which allows easy alignment of the door during assembly.

Mounted within the safe housing 110 is frame 200 of the coin and bill dispensing assembly. This frame 200 includes a left wall 210 and a right wall 212. The top and bottom walls of frame 200 allow the tray assembly for all the coin and bill trays to be optionally assembled as a unit outside the safe enclosure and then mounted as a unit within the safe enclosure 110. The frame 200 can also provide a supporting surface for the mounting of the bill acceptors 150 and 151 to the outside wall of the frame assembly 200. Alternatively, the mounting of the bill acceptors can be directly to an interior surface of the safe housing 110. The subassembly of the coin and bill tray assembly allows the tighter tolerances required to ensure each tray is properly mounted and can easily slide in and out as will be discussed below. The thicker metal of the safe housing 110 therefore does not need to have the more precise tolerances associated with the coin and bill trays.

The tray frame 200 also provides a base to mount a floating connector 230 which will interface with a mating connector mounted on the door 120. As will be discussed later, all interconnects to the door such as LED indicators and an optional electronic lock, for example, will preferably be powered through this floating connector.

With the door 120 removed, a better picture of the bill acceptors 150 and 151 can be seen. In particular, each bill acceptor has associated with it a cassette 152 and 153 in which accepted bills are stored.

Access to electrical interfaces is made through an opening in the side 240 or back of the safe enclosure 110. A panel is mounted on the inside of the safe with various connectors that expose the connectors through opening 110. Power, typically 24 VDC, and logic signals, typically RS232, RS485, Ethernet, USB, or an RF antenna will be plugged into this plate (not shown).

Figure 3:
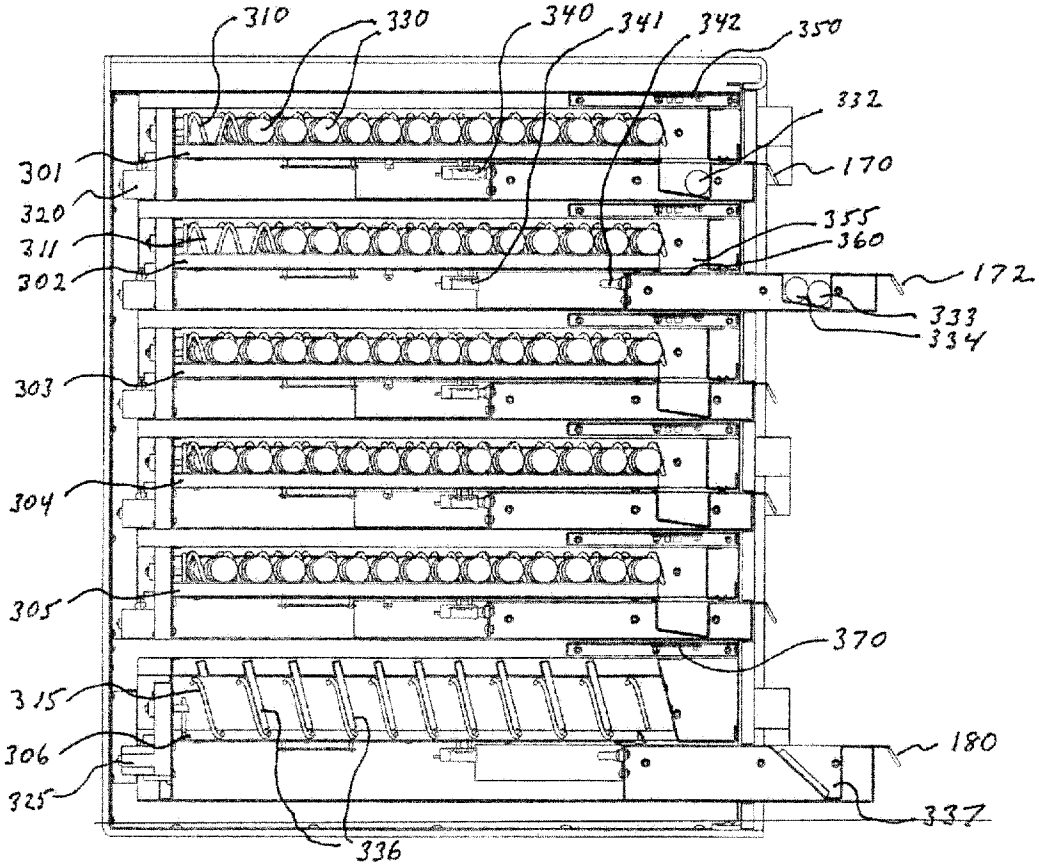
FIG. 3 is a cutout side view of the cash accepting and dispensing safe of FIG. 1.

A more detailed discussion of the operation of the rolled coin and bill dispenser is provided in conjunction with the cutaway side view shown in FIG. 3. Five rolled coin trays are shown with a topmost 301 through a bottom most 305. The lowest tray shown is a stacked bill tray 306. Each tray has an associated pull drawer. With reference to the top drawer 301, the pull drawer 170 is shown in the closed position. During normal coin dispense operation, the pull drawer must be in its closed position. A switch assembly 340 provides a signal used to determine that the drawer is closed. The operation of the switch assembly will be discussed in more detail below, but the two parts to the switch assembly can be seen in reference to the second tray assembly 302 in which the switch 341 and switch activator 342 are shown with the pull drawer 172 in the open position. An optional drawer locking mechanism (not shown) can be used to insure the drawer is locked closed except when access is needed by the user. As one example, a solenoid can be employed to retract a locking bolt from a cutout in a drawer to unlock the drawer. A spring may passively hold the locking bolt in the lock position to lock the drawer when the solenoid is not activated.

The topmost rolled coin tray 301 is addressed in detail below as indicative of each rolled coin tray. Each coin tray has associated with it motor assemblies 320. The motor assemblies preferably include DC motors and an associated gearing subassembly, not shown, to allow the shaft of the motor assemblies to turn at a modest speed when the motor is energized. The gear ratio used is such that the torque needed to move all rolls of coins in the column controlled by the motor is met. Each tray has one or more motor assemblies with associated components as described above and in more detail below. FIG. 3 shows a series of rolled coins 330 in each of the columns shown in each tray. The uppermost tray 301 shows 13 rolls of coins 330 in the column shown. An additional roll of coins 332 is shown in the pull drawer 170. Associated with each column of each tray is a spiral 310 that holds the rolls of coins. When the motor 320 is energized, the spiral turns pushing each roll of coins forward until the front most roll of coins falls into the well of pull drawer 170 as shown.

Also associated with each tray is a sensor board like sensor board 350 shown for the top most tray 301. The sensors detect the roll of coins being dispensed and a signal is derived from the sensor board 350 and transmitted to a control board described later. The manner of detection is also described in more detail later. It will be recognized that in a simplified version where the need to monitor the inventory in the safe is not needed, the sensor boards can be eliminated.

When a pull drawer is not in the closed position, such as second tray 302 shown open, the associated switch 341 indicates to the controller not to attempt to dispense a roll of coins until the tray is in the closed position. The pull drawer 172 for open second tray 302 has two rolls of coins 333 and 334 ready to be taken out by the user. It should be noted that when the pull drawer 172 is in the open position, the drop opening 355 position is blocked by the pull drawer shelf 360. This arrangement serves to ensure no additional rolls of coins can be accessed. The distance between the pull drawer opening housing the dispensed rolls of coins 333 and 334 and the drop opening 355 position is more than sufficient to ensure it is not possible to reach inside and grab a roll of coins from the spiral 311. Alternatively, an optional sensor or sensors may be employed to detect such an attempt and a controller can sound an alarm in response to detecting such an attempt.

The operation relative to stacked bill drops is similar to that for rolled coin or rolled bill drops. The bottom most tray 306 illustrates a spiral 315 with ten stacks of bills 336 in the column shown in FIG. 3. The pull drawer 180 for the bill stacks 336 is deeper than the rolled coin pull drawers to allow for the size of bills. Further, the pull drawer 180 has a well profile 337 to allow the stack of bills to slide into the well more readily than the steep slope associated with the rolled coins.

Not shown in FIG. 3, and discussed in more detail later is the manner in which the bill stacks lie in the spirals. For each column of bill stacks, two opposing spirals are needed to keep the bill stacks properly aligned to be dispensed into the pull drawer well 337. The two spirals are operated by two associated motor assemblies 325 simultaneously to achieve this alignment. Each motor assembly 325 has a switch on it to establish a home position. This arrangement allows an auto alignment of the bill stacks after each dispense by ensuring both motors in the pair are at their home position.

The bill stack preferably includes a wrapper which has a detectable indicium, such as a barcode or RFID tag, embedded in it. The sensing system is preferably an RFID system with a sensor board 370 mounted such that RFID sensors read an RFID tag on the wrapper. More details relative to this sensor system will be discussed below.

Figure 4A:
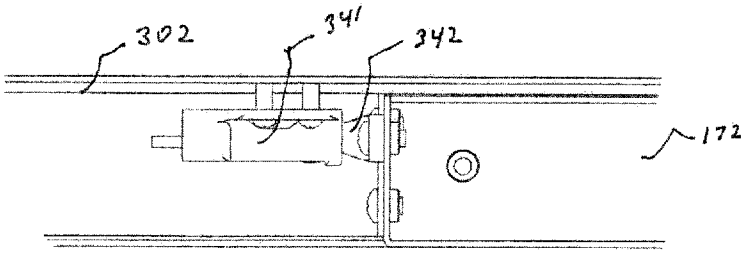
FIG. 4*a* is a close up view of a pull tray interlock system with drawer closed.
Figure 4B:
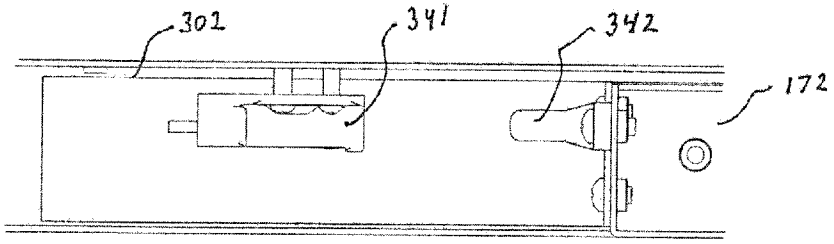
FIG. 4*b* is a close up view of the pull tray interlock system with drawer open.

The dispensing of rolls of coins or bills occurs when the motor assemblies are energized. To ensure only the proper amount of money is dispensed and tracked, the motors cannot be energized unless the pull drawers are in their closed position. FIGS. 4*a* and 4*b* are enlarged sectional views illustrating one suitable relationship between the pull drawer switch elements. The presently preferred embodiment of the current invention uses a push to close and pull to open grabber catch with an integral microswitch. Specifically, a Southco C3 mechanical latch with an electrical switch is suitably used. The catch portion 341 is mounted to the underside of the drawer 302. The switch activator 342 is mounted to the pull drawer 172 associated with the drawer 302. The switch activator 342 is shown engaged with the catch in FIG. 4*a* and disengaged from the catch in FIG. 4*b*. When engaged, the switch arrangement produces a short between two conductors (not shown) creating a detectable signal that is sent back to the controller. The detection of this signal by the controller causes it to respond to allow the dispensing of coins (or bills) when the drawer is in this closed state. When disengaged, the signal is open from the switch output indicating to the controller that dispensing cannot occur for this particular tray.

The drawer "closed" position is required to allow the dispensing of rolls of coins or stacks of bills in a given tray. Once the coins or bills are dispensed into the tray, indicator lights, such as LED lights, are used to provide feedback to the user to indicate the drawer is ready to be pulled out to collect the dispensed coins or bills. If drawer locks are used, these would be energized to allow the drawers to be opened. Examples of these indicator LEDs 190 and 191 are best seen in FIG. 1. More specifically, one of the indicator LEDs will indicate whether the door is closed and the other will indicate it is time to open the drawer to collect the dispensed money.

Figure 4C:
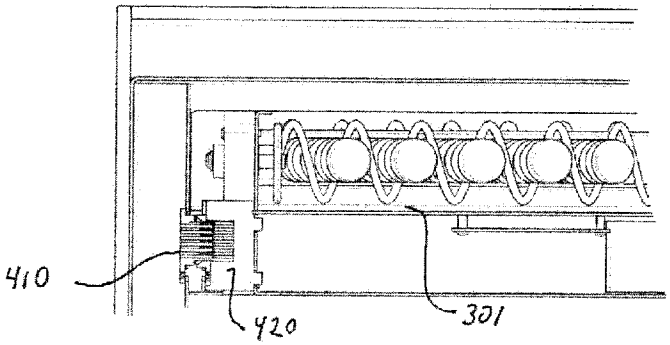
FIG. 4*c* is a close up view of a coin tray with the tray in the closed or fully seated position.
Figure 4D:
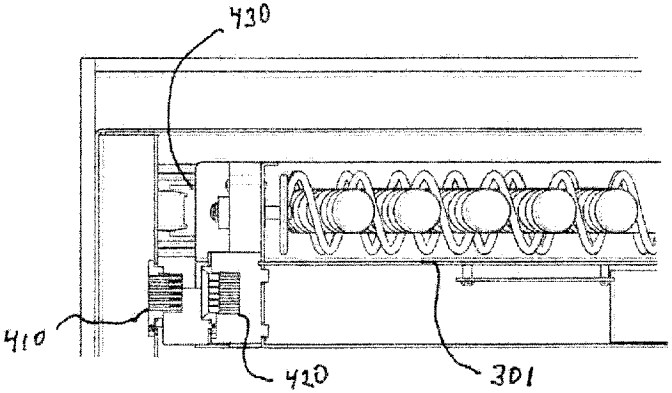
FIG. 4*d* is a close up view of the coin tray with the tray in the open position.

Power to each tray is provided through a floating connector arrangement. One embodiment of this arrangement is shown in FIGS. 4*c* and 4*d*. The floating receptacle 410 is preferably a Molex Micro-Fit BMI Floating Panel Receptacle. This connector family is available with various numbers of circuits as needed. The mating connector 420 is mounted on the moveable tray 301 and is preferably a Molex Micro-Fit Dual Row BMI Panel Mount Plug intended to mate with the floating receptacle 410. It will be apparent to one skilled in the art that a number of alternative connector sets can be used. FIG. 4*c* shows the tray in its fully seated position allowing power and signals to be conducted to the electronics and motors within the tray 301 through connector set 410 and 420.

The tray can be pulled forward to disengage the connector set 410 and 420 as shown in FIG. 4*d*. The entire tray 301 can be pulled forward and will ride on a pair of sliders 430 in a manner similar to the operation of the drawers as described above. The drawer 301 should be pulled to its forward most position when loading the tray with rolls of coins, rolls of bills or stacks of bills.

Figure 5:
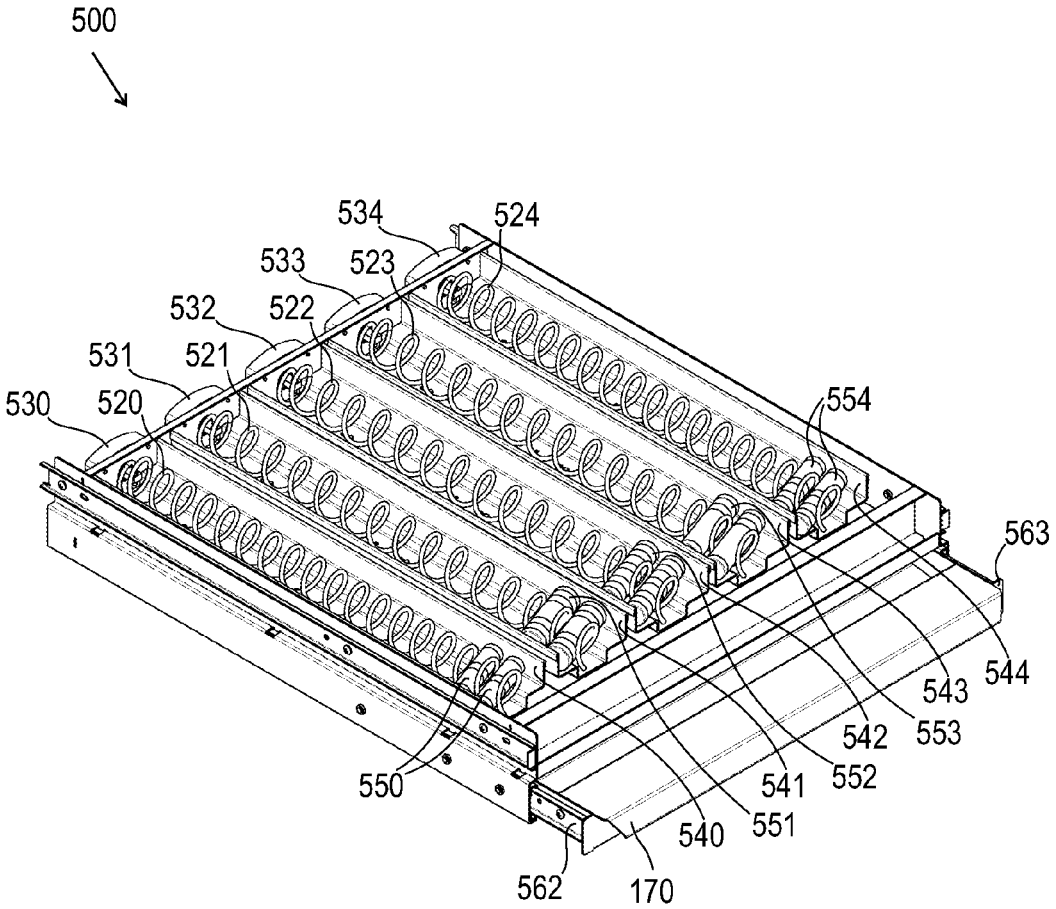
FIG. 5 is a rolled coin dispensing tray.

Each rolled coin tray 500 allows a number of spirals of rolled coins to be held and dispensed. Referring to FIG. 5, a tray 500 typical of the current invention is shown with five rolled coin spirals. The spirals can be configured to optimize the number of rolls of a specific coin type that can be housed in a given machine depth. In a preferred embodiment of the current invention, two spiral pitches are used. One is sized to allow seventeen rolls of pennies, nickels, or dimes to fit in the column. In FIG. 5, spiral 520 is shown holding two rolls of the possible seventeen rolls of dimes 550. Spiral 521 is shown holding two rolls of the possible seventeen rolls of nickels 551. Spiral 524 is shown holding two rolls of the possible seventeen rolls of pennies 554. Of course the total number of rolls is dependent on the depth of the tray. A second spiral pitch is shown holding fourteen rolls of quarters or dollar coins. Spirals 522 and 523 are shown with this pitch allowing the dispensing of quarters 552 or dollar coins 553. Each spiral is driven by an associated gear motor 530, 531, 532, 533, 534, which, when energized will rotate the spiral and push the rolls of coins forward. Each coin roll type also has a guide channel to hold the roll of coins relatively constant side to side. Thus, the channel for the dimes 540 is narrower than that of the pennies 544. Likewise the channels for the nickels, quarters, and dollar coins, 541, 542, 543 are sized to provide the same relative tolerances side to side.

It should be noted that by varying the pitch of the spirals and the width of the channels, any size roll of coins or tubes can be handled. In cases where a minimum number of bills are to be dispensed, it is therefore an option to put the bills in a tube or rolled in an envelope and dispense bills in this manner as well. Likewise, tokens, casino chips, or the like can also be dispensed in a similar fashion.

The current invention uses a drawer within a drawer technique to provide the dispensing required, high security of the rolls of coins stored, and ease of loading the rolls of coins into the equipment. We have discussed the pull drawer 170 earlier as the component the user will pull to remove the rolls of coins or stacks of bills dispensed. The drawer 170 is shown in further detail in FIG. 5 and can be seen as having sliders 562 and 563 which mate the pull drawer to the bottom of the tray 500. In normal operation, the tray is fully seated inside the coin and bill dispensing safe and secured by the safe door.

When the safe door is open, each tray can be pulled out as well. The tray 500 is mounted to the tray frame 210 shown in FIG. 2 through sliders 560 and 561. The entire tray 500 slides on these sliders extending the tray out of the machine exposing all the spirals in the tray. This allows for quick and easy loading of the rolls of coins in each column of each tray. The tray sliders 560 and 561 mate with the slider housing 430, shown in FIG. 4*d*.

To further simplify the loading process and to help ensure the correct rolls of coins or tubes are properly inserted into each spiral, a color coding scheme can be used (not shown). In particular, each rolled coin channel will be color coded for the particular coin roll it is designed to dispense. For example, rolls of dimes 550 will use the smallest coin channel 540 for U.S. coins. The dime channel 540 will be a particular color, for example, blue. The pennies channel may be orange; the nickel channel may be green; quarters may be red, and so on. Additionally, the rolls of coins will have a coin wrapper which may contain the same color as the channel it is intended to be dispensed from. This allows easy visual identification of specific coin types and the channel they are intended to be inserted into. Similarly, words such as "dime", "penny", etc. can be printed on the channels to identify the coin types to be inserted. Alternately, numbers or any other identifying criteria can be used to identify the coin type to be inserted into the specific spiral.

Figure 6A:
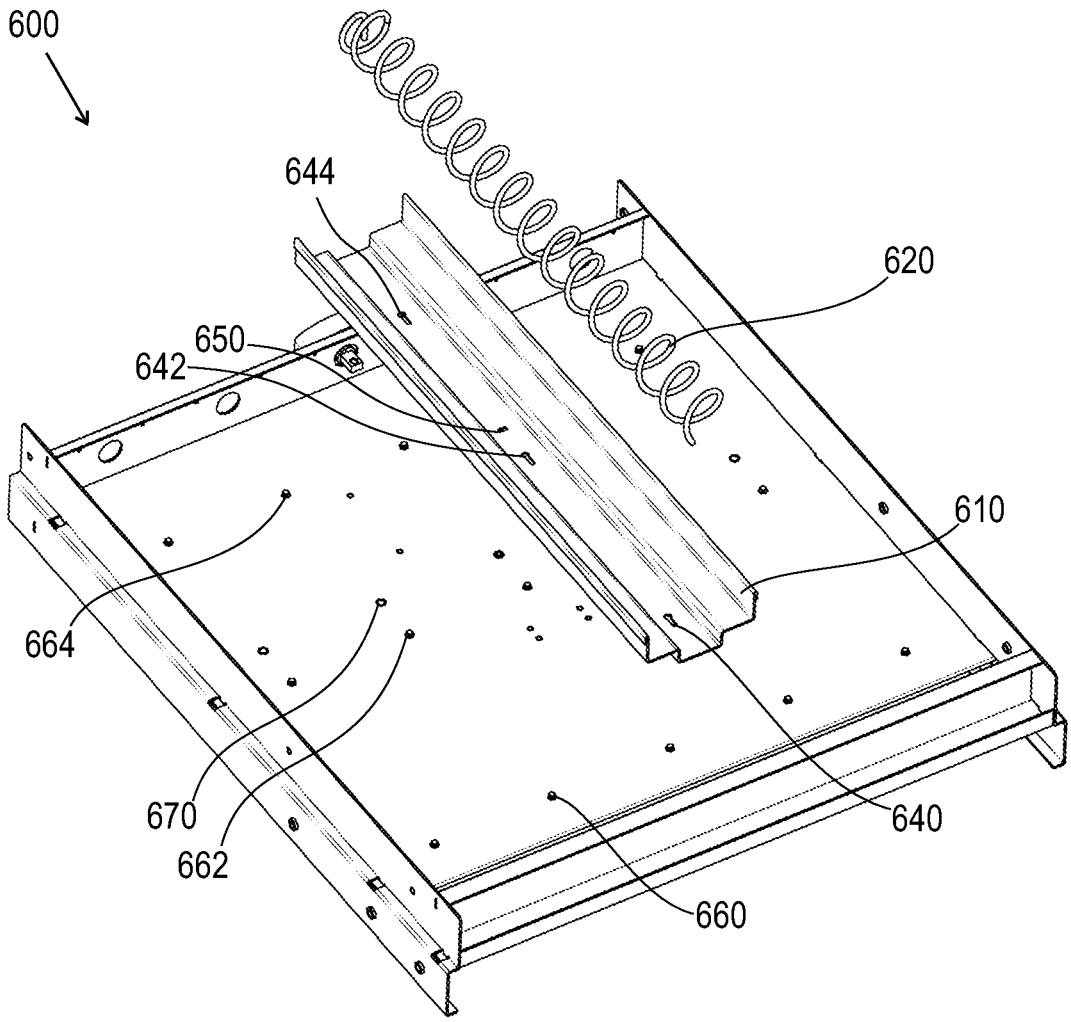
FIG. 6*a* is a view of a coin dispensing tray demonstrating an exemplary coin tray adaptor and coil assembly.
Figure 6B:
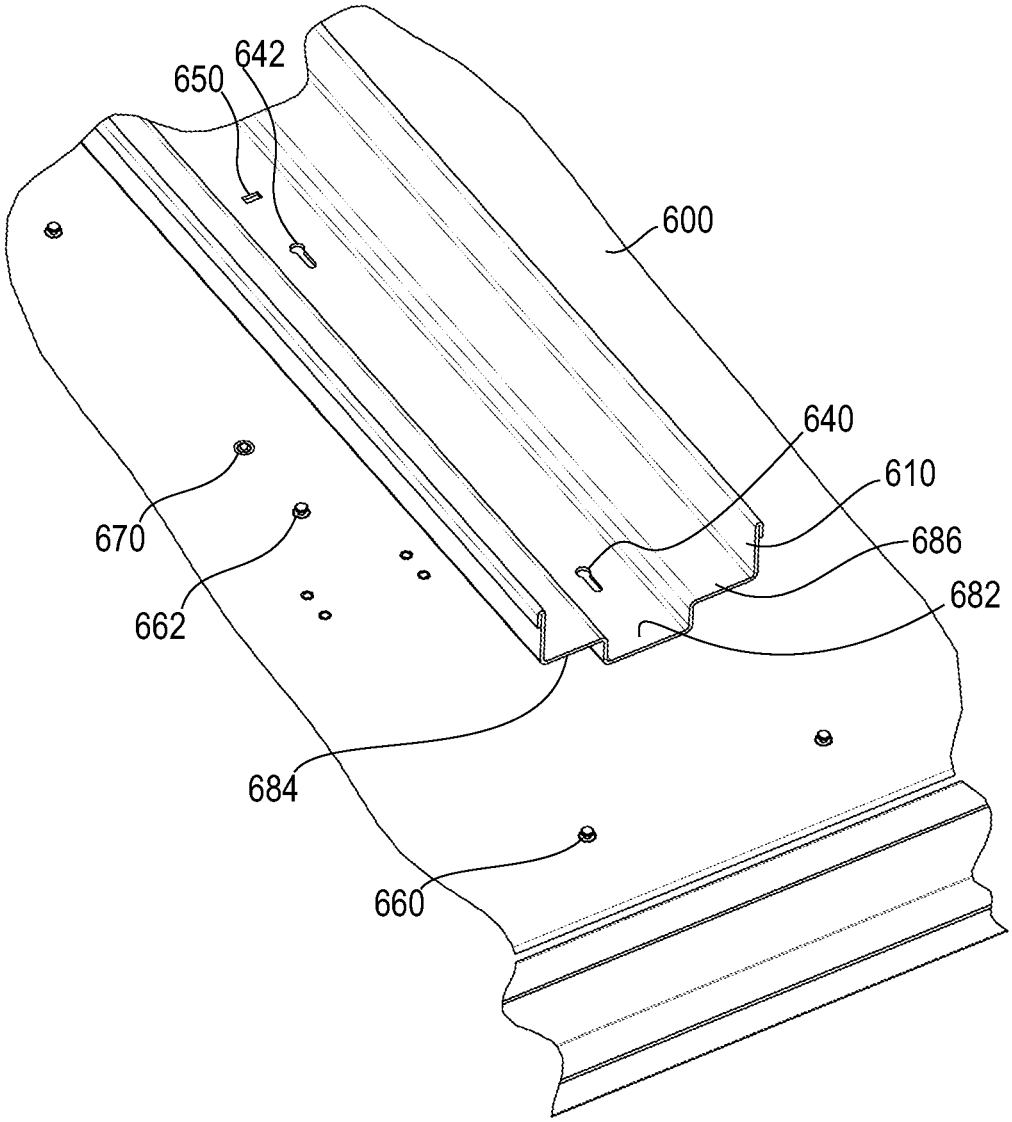
FIG. 6*b* is a close up view of the installation of a coin tray adaptor.
Figure 6C:
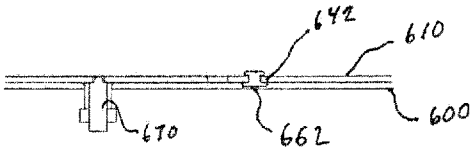
FIG. 6*c* is a side view of the coin tray adaptor latching feature.

To enhance the flexibility of the dispensing safe and to allow adaptability for different rolled coin or tube products, each tray can be easily modified to accommodate different channels and spirals. This is best shown with reference to FIGS. 6*a*, 6*b*, and 6*c*. Referring to FIG. 6*a*, tray 600 is shown without the channels or spirals mounted. Channel 610 is shown with location keys 640, 642, and 644. Each channel is aligned with pins in the tray. By way of example, tray location key 640 could line up with tray pin 660, key 642 with pin 662, and key 644 with pin 664. A closer view of the keys and pins is shown in FIG. 6*b*. Each channel 610 also has a position lock opening 650 which when aligned properly by placing the keys over their associated pins and shifting the channel rearward allows the spring loaded plunger 670 to hold the channel in place. A side view of the locked in channel 610 to the tray 600 is shown in FIG. 6*c*. Pin 662 is shown aligned with key 642 of channel 610 and locked in place by the spring loaded plunger 670. Although there are a number of spring loaded plungers that can be used, a preferred spring loaded plunger is the McMaster-Carr 8499A127 Zinc plated Steel Round Nose Spring Plunger with Delrin nose. A number of alternate position lock techniques can be used including those with various spring loaded balls, levers and buttons. Either the approach described above with a detent force required to dislodge the tray or the requirement to manually depress or pull the spring loaded device can be used. Alternatively, a pin in socket device can be used to lock the trays in place.

Each channel is designed in a presently preferred embodiment of the current invention to allow the optimization of the channel with the roll intended to be dispensed. The width of the channel 610 is set to allow the rolls to be confined laterally when placed in the spiral 620. The channel profile is designed to provide both supports for the rolls or stacks being dispensed, as well as, minimizing the friction of the rolls or stacks being dispensed. Referring to FIG. 6*b*, the mounting of the channel as described above is relative to channel surface 682. The rolls being dispensed ride on surfaces 684 and 686 so that only these surfaces are in contact with the rolls. The choice of widths of surfaces 684 and 686 are designed to minimize the friction with the dispensing rolls and can be optimized to ensure the required support needed while minimizing friction. The lower the friction the smaller the motor assemblies and power required to drive the spirals. Low friction also minimizes the possibility of rolls jamming while being dispensed.

The current invention provides for the ability to determine the value of rolls of coins or tubes of products as well as stacks of bills in the safe. Additionally as each roll, tube or stack is dispensed, the value and quantity of dispensed items are tracked. Specifically, a tracking technique for rolls of coins or tubes of products is described in detail below.

Figure 7:
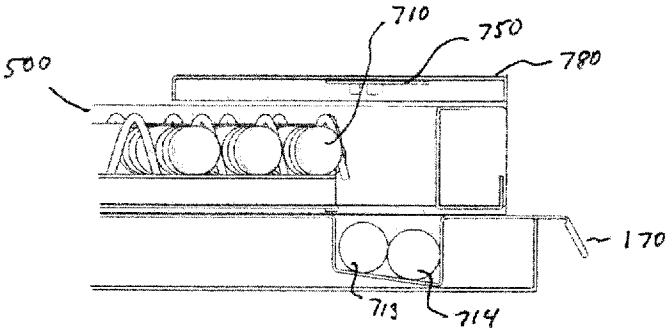
FIG. 7 is a close-up side view showing the relationship between the rolled coin tray and sensor board.

Further details of sensor board 350 discussed earlier with reference to FIG. 3 are provided in connection with the discussion of board 750 of FIG. 7. This sensor board 750 is mounted to a member 780 of the dispense frame 200 described in FIG. 3 above. Hence, the sensor board is stationary relative to the frame holding both the tray 500 and the pull drawer 170. The position of the sensor board 750 is set so that in normal operation the rolled coins 710 just pass under the sensors as they drop to the pull drawer 170. The rolled coins 710 are rolled in a wrapper with an optical code printed on it which will be described in more detail below. The sensor board 750 has sensors on it located to detect the optical codes on the rolled coin wrappers. As the rolled coins are passed below the sensors on the sensor board 750, data is sent to the controller indicative of the value of the rolled coin or tube of products being dispensed. In the current embodiment, it can be seen that up to two rolls of coins 713 and 714 or tubes of product can be dispensed into the pull drawer for each spiral in the tray. This allows a multitude of rolls of coins or tubes of products to be dispensed before the drawer needs to be pulled open to access the dispensed funds. Each tray similarly can have multiple rolls dispensed before the drawer needs to be pulled. As will be discussed below, this approach allows significant flexibility to dispense many different roll types quickly and can be optimized to require a minimum number of drawer pull accesses to retrieve the dispensed money, as discussed in more detail below.

When the safe door is opened, the entire tray 500 can be pulled out as described above. The sensor board 750 remains stationery in the safe enclosure. Hence, each of the spirals of rolled coins or tubes are passed under the sensors on the sensor board 750 as the tray is both pulled out for loading and as it is pushed back in place after loading. As the tray is being passed below the sensors 750, each roll or tube in each spiral of each tray can be "read" by the sensors thus allowing a full and accurate inventory of every roll or tube in the safe. This inventory is updated or readjusted every time the tray is inserted so the reloading of tubes or rolls is always counted. Additionally, as will be described in more detail below, the sensing approach has the ability to know what type of roll or tube is expected in each spiral in each tray and can flag errors in loading the machine, or alternatively account for the error and correct for it when dispensing.

Figure 8A:
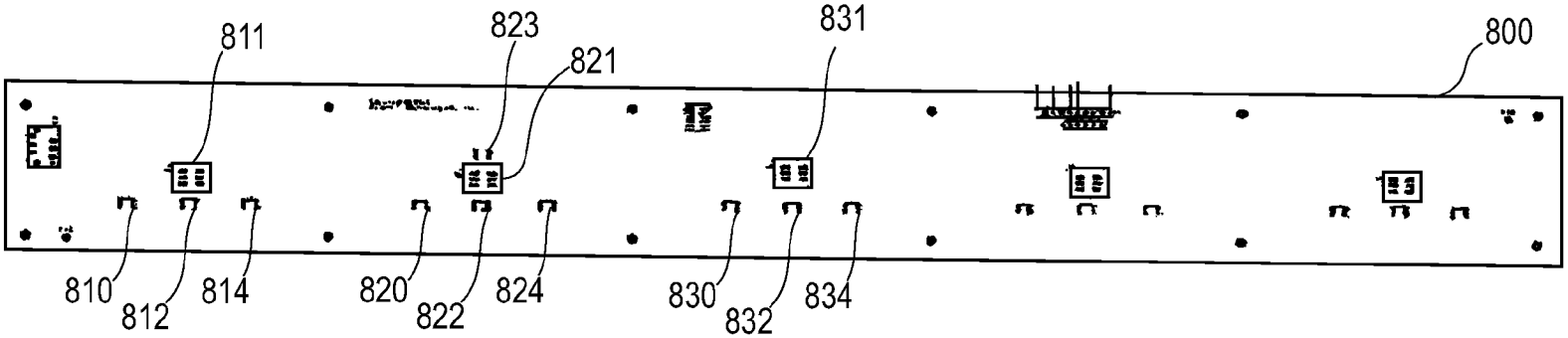
FIG. 8*a* is a front view of a printed circuit board showing sensor components.
Figure 8B:
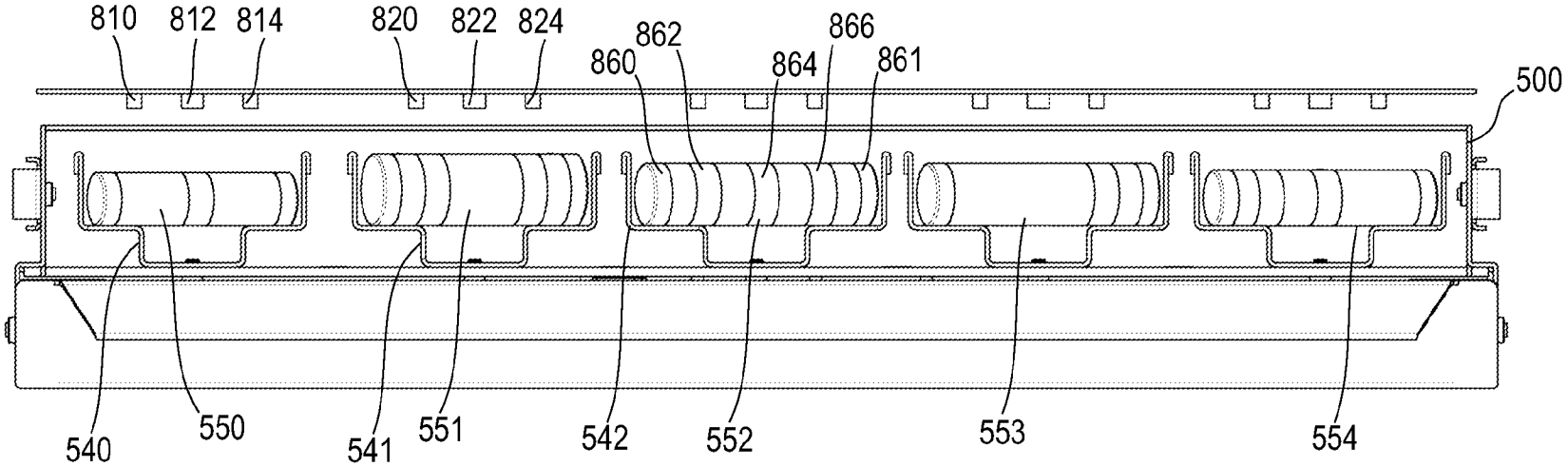
FIG. 8*b* is a cutout front view of a rolled coin tray with rolls of different coin types and their relationship to the sensors.

The sensing arrangement for identifying rolled coins and tubes is best described with reference to FIGS. 8*a* and 8*b*. FIG. 8*a* shows a printed circuit board 800 which spans the width of the tray 500 as shown in FIG. 8*b*. For each channel in the tray, a set of sensors is provided on the printed circuit board. Thus, for channel 540, there are three receivers, 810, 812, and 814 on the sensor board as well as a transmitter 811. Similarly for channel 541 there are three receivers 820, 822, and 824 on the sensor board as well as a transmitter 821. Each of the transmitters 811 and 821 may suitably be a three color LED assembly; however, it will be recognized that each receiver may have its own separate corresponding transmitter. There is also a fourth receiver 823 shown for this channel that will be discussed later. Aligned to each of the receivers on the sensor boards, the rolled coins or tubes will have a wrapper with circular bands printed on them. By way of example, the center channel 542 shown in FIG. 8*b* has two end bands 860 and 861 which are optionally used for detection, but not in the example shown. However these two bands would be color coded to match the color of the channel 542 as discussed above to easily associate the proper roll coins are put in this channel. Hence, if the channel were blue, the end bands on the roll of coins would be blue.

In the current example, the next band after end band 860 is band 862. This band, along with bands 864 and 866 would be present or not and detectable by the receiver sensors 830, 832 and 834 respectively. Additionally, the color of each of these bands can be chosen to allow a large number of combinations to exist allowing for alternate currencies or tubes of products to be uniquely detected. The transmitter 831 is preferably a three color LED assembly. Alternatively, individual colored transmitters corresponding to receivers 830, 832 and 834 may be suitably employed. Each of the receivers 830, 832, and 834 are wide spectrum optical receivers capable of receiving light reflected off the associated band beneath the receiver. Therefore, if the bands for a particular rolled coin type were blue, then the strongest reflected signal received by the receivers would be when the blue LED was energized. If the bands were red, the strongest reflected signal received by the receivers would be when the red LED was energized. By controlling the position, presence or absence of bands, and the color of bands, each type of rolled coin or tube can be uniquely determined. For a small set of possible tubes, such as the U.S. coin set including a roll of pennies, nickels, dimes and quarters, only one color would be needed as the position and presence of bands can uniquely determine the four options available. FIG. 8*b* shows up to five unique rolled coin types, based on the presence of bands alone. The leftmost rolled coin example 550 has one band in the center of the roll in addition to the two end bands which is color coded just for ease of loading the machine. The second rolled coin type 551 is shown to have two bands present with the center band missing. The third rolled coin type 552 is shown to have three bands present. The fourth rolled coin type 553 is shown to have only one band on the right side present. This would eliminate the possibility of having one band on the left side as the rolled coins can easily be put in place in either direction. The fifth rolled coin type 554 shown has two bands adjacent to each other. Again, as the rolls can be put in either direction, the other two adjacent bands combination cannot be used.

It will also be appreciated that in the case of only a few rolled coin types as in the U.S. coin set, a simplified solution can be implemented using only color detection to determine the coin type. Thus, without decoding the color bands, but just determining the color used, it would be fairly simple to distinguish between the coin types present. The use of the bands increases the security of the system in that the rolls used for the coins would have to be made and used, ensuring the source of the coins can be controlled. Alternatively, in a simplified system, recognition of the rolls of coins or bills can be determined without the use of bands on the rolls or different colors, but rather by measuring the diameter of the rolls, or other physical parameters of the roll being sensed. It will also be recognized that techniques other than optical sensors can be used to distinguish roll types including weight and the like. RFID and similar technology tags, discussed later, can be used as well. While less secure and accurate than the preferred embodiments, an advantage of these latter implementations, is that standard rolls of coins or standard tubes can be used.

Figure 9:
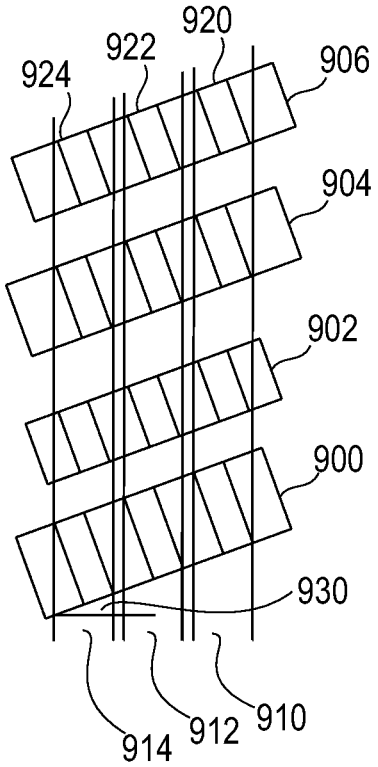
FIG. 9 shows the relative positioning of encoded bars on the various size coin rolls.

The choice of sensor receivers and LED light sources is important to ensure all the bands will be properly lit with enough light energy resulting in ample light reflection back to the receivers. In particular, the rolls of coins or tubes are not passing under the sensors with perpendicular alignment. As best shown in FIG. 5, the rolls of coins or tubes are in the spirals at an angle relative to the printed circuit board. The relationship between the rolls of coins and the sensors is further illustrated in FIG. 9. Four variations of rolls of coins or tubes are shown as 900, 902, 904, and 906 respectively. This arrangement coincides with rolls of U.S. quarters, dimes, nickels and pennies, respectively. Each of these rolls is shown with the three possible bands 920, 922, and 924 described earlier consistent with a preferred embodiment of the current invention. FIG. 9 further shows the rolls of coins at an angle 930 which in the preferred embodiment is 20 degrees and is due to the spiral configuration. The receivers used to detect the light reflected from the bands are selected to have an angular response of 25 degrees which based on the position of the sensors to the rolled coins results in sensitivity bands shown as 910, 912 and 914 for the three band receivers respectively. In order to ensure a sufficient light source is used, the angle of transmission of the light from the LED source in the current preferred embodiment is 120 degrees. A single LED with a 120 degree angle of light dispersion will allow reflection of each band back to its respective receiver. The receivers used in a preferred embodiment are the TI Electronics OP525 phototransistor. The transmitters used in one embodiment are the Cree CLV6A-FKB RGB LED. Alternatively, separate single color red, green and blue LEDs may be employed as transmitters.

Referring back to FIG. 8*a*, an additional receiver 823 is shown positioned in line with receiver 822. This receiver will function identically to that of receiver 822 receiving the reflections from the same roll and channel as receiver 822. However, the timing of the reflected signal received on receiver 823 is offset from that of receiver 822. By monitoring which of receivers 822 or 823 signals arrive first, the direction of motion of the tray can be determined. Hence, if person loading the machine attempts to defeat the sensing system and generate incorrect counts by moving the tray in and out, this will be determined and an alarm signal can be transmitted or an alarm set.

It should be noted that any of the receivers can be used to additionally monitor the spirals as they pass beneath the sensors. This monitoring allows the speed of travel of the tray to be determined and whether any rolls or stacks are missing between spirals. It also allows a check on whether the number of turns of the spiral is correct for an intended tube diameter. Hence, a number of cheat attempts or errors in loading can be determined and corrected or alarms sent to indicate a potential problem. Additionally, instructions to pull the drawer back out and re-insert the drawer can be displayed to the service person if the counts are in question. This approach allows an immediate action to take place to correct any questionable readings due to problems inserting the tray.

Figures 1, 10A:
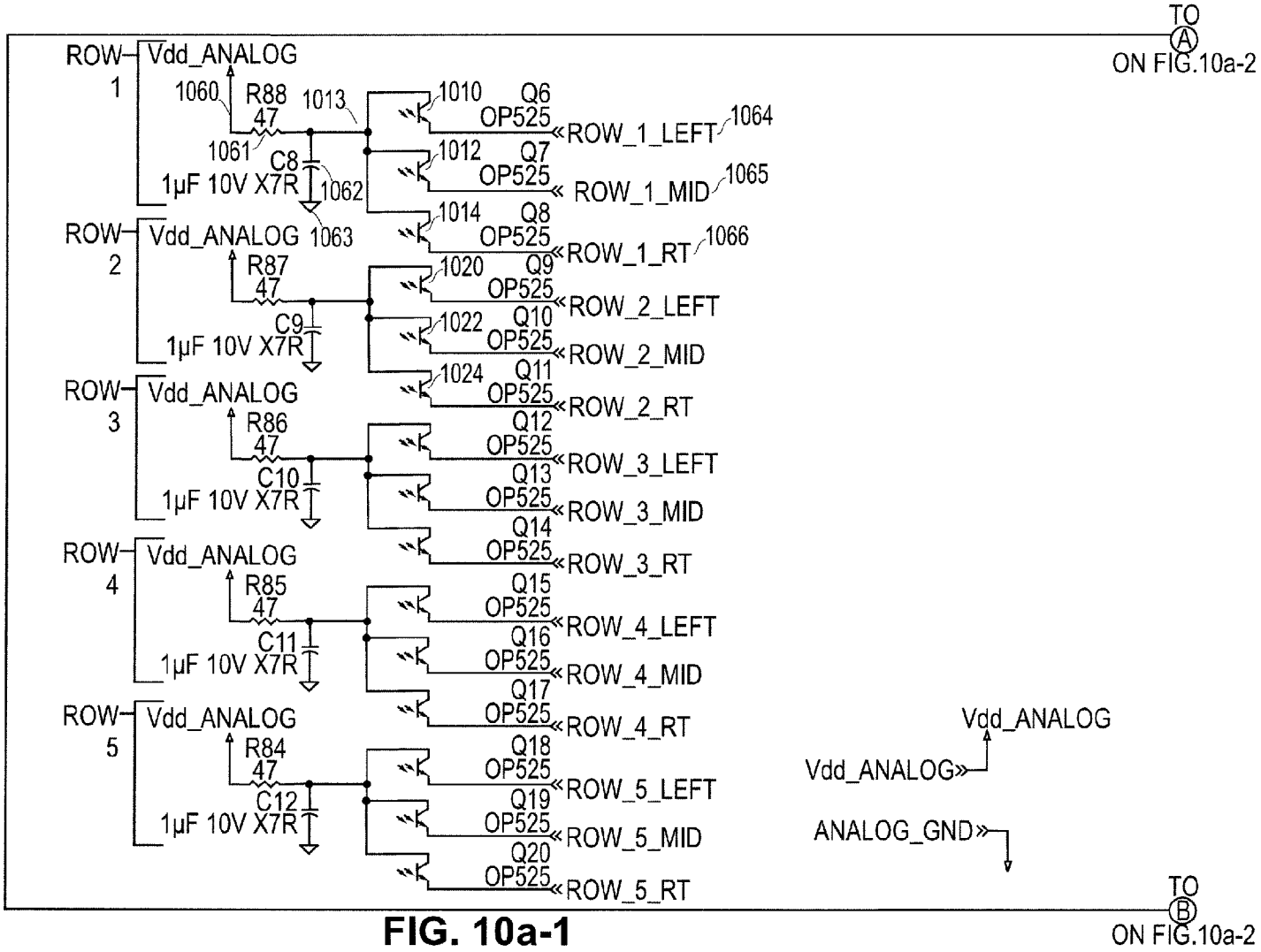
Figures 2, 10A:
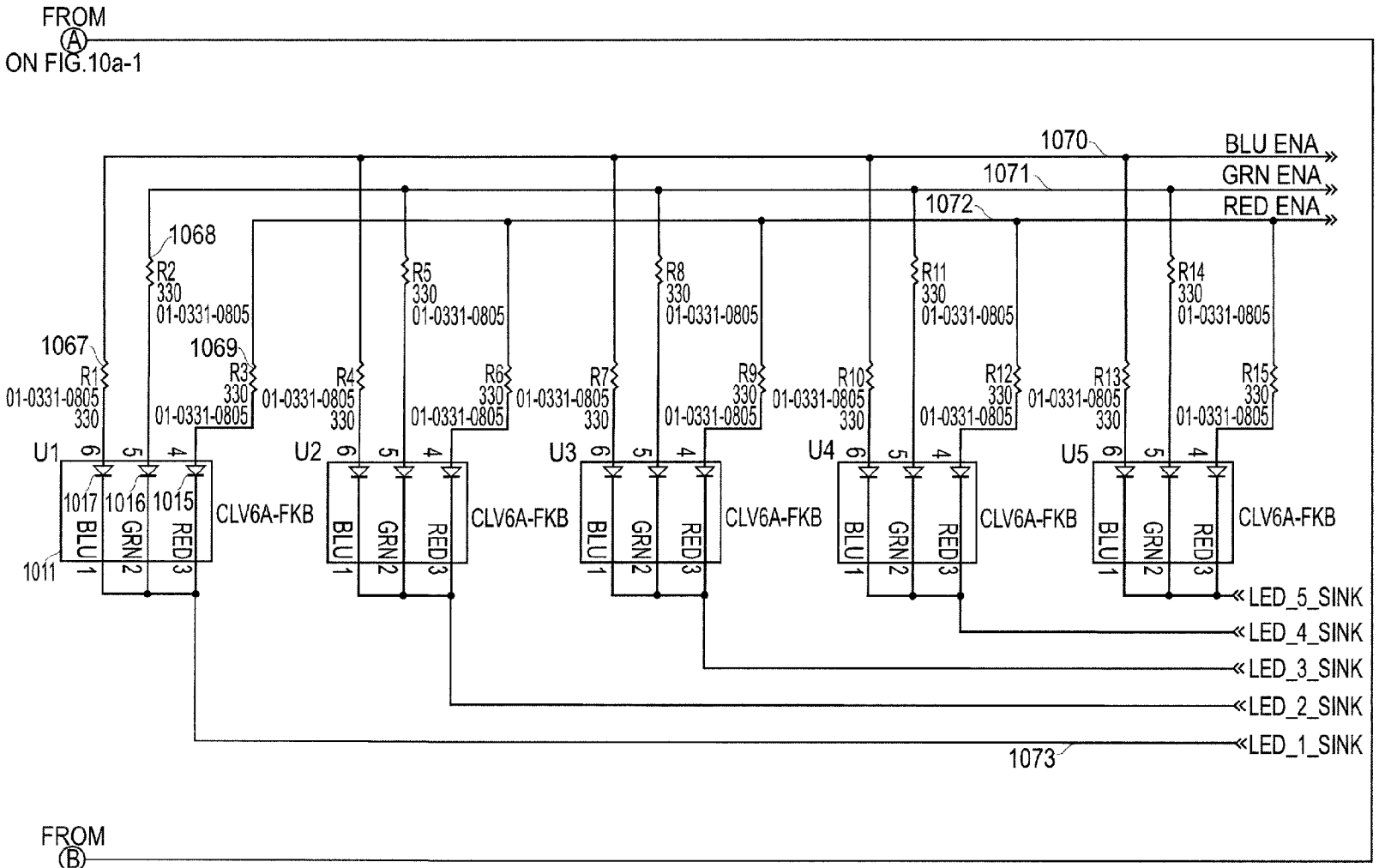

FIG. 10*a* is a schematic showing the electrical configuration of the sensor receivers and LED light sources described above. Each of the optical receivers is a phototransistor preferably a TI Electronics OP525 device. Every roll coin tray has an associated sensor board as discussed above. The association of each of the sensor photo transistors can best be understood in reference to FIGS. 8*a*, 8*b*, and 10*a*. The three receivers designated as receivers 810, 812 and 814 are associated with the first channel 540 aligning with the first column of rolled coins 550. The schematic representations of these three sensors are 1010, 1012, and 1014 respectively. Similarly, the three sensors designated as 820, 822, and 824 in FIG. 8*a* correspond to the second channel 541 associated with the second column of rolled coins 551 in FIG. 8*b*. These three receivers are schematically represented by sensors 1020, 1022, and 1024 in FIG. 10*b*. The other sets of three sensors for each of the remaining columns of rolled coins similarly match the respective sensors in the schematic of FIG. 10*a*. Each of these phototransistors will receive reflected light from a respective band on the rolled coin wrapper as described above.

The light source for each channel is associated with the set of three phototransistors in a similar fashion. The transmitting LED light source for the first channel 540 associated with the sensor set including phototransistors 810, 812, and 814 is LED 811 shown in FIG. 8*a*. This LED is schematically shown in FIG. 10*a* as element 1011 and consists of three LEDs in a single package with a Cree CLV6A-FKB RGB LED presently preferred. The three LED's in this package include a red LED 1015, a green LED 1016, and a blue LED 1017. It is well known in the art that by controlling the amount of light from each of a red, blue and green light source, any color light can be created, including white light.

The schematic further shows that each of the three LEDs contained in the LED package 1011 is individually controllable with individual source enable lines 1070 for the blue LED, 1071 for the green LED and 1072 for the red LED. Each LED also has a current limiting resistor which in the preferred embodiment is 330 ohms and shown as resistor 1067, 1068 and 1069, respectively in FIG. 10*b*. The schematic further shows the preferred means of controlling the LEDs for each channel of a particular tray by having them electrically configured in a matrix configuration. For example, bringing the LED_1_Sink 1073 line to near 0 volts or ground potential and bringing one or more of the RED_ENA 1072, GRN_ENA 1071, or BLU_ENA 1070 lines to a voltage potential, 5 volts in the preferred embodiment will cause the LEDs 1015, 1016, and 1017 to light.

The phototransistors are shown with the collectors 1013 of each set of three common channel sensors electrically connected together in the case of the first channel set of sensors 1010, 1012, and 1014. The common collectors 1013 are each supplied by a voltage source 1060 preferably 5 volts through a filter circuit using a 47 ohm resistor 1061 and 1 microfarad capacitor 1062. The supply voltage 1060 for this circuit is indicated as Vdd_ANALOG and the ground reference 1063 as ANALOG_GND. The output or emitter of each phototransistor is individually returned to a microcomputer through conductors 1064, 1065 and 1066 referenced as ROW_1_LEFT, ROW_1_MID, and ROW_1_RT, so the signal level for each of the three sensors can be analyzed by an analog to digital input to the microcomputer as discussed below.

Figure 10B:
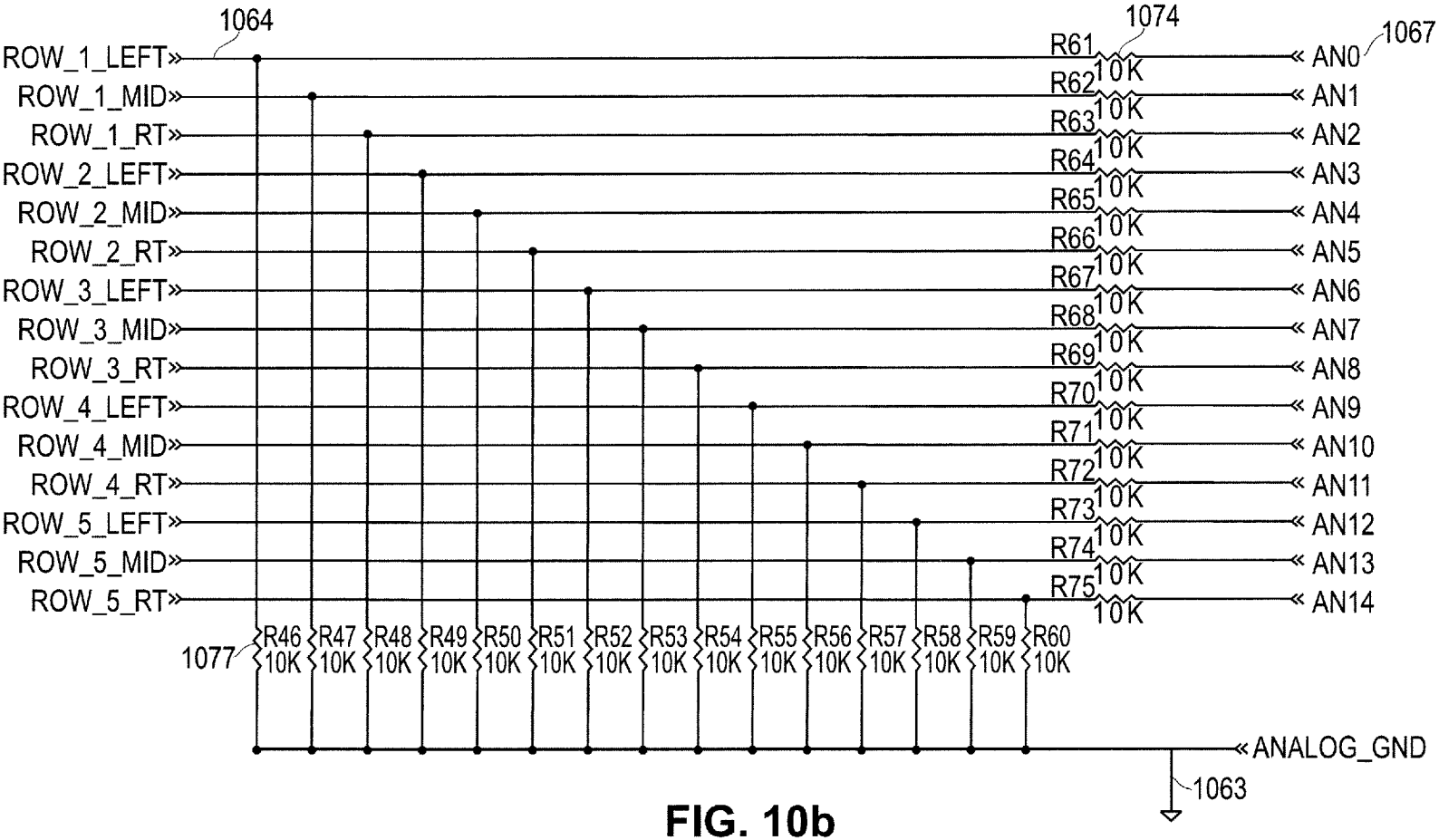
FIG. 10*b* is a schematic of the biasing circuit used in conjunction with the receiver's optics in a presently preferred embodiment.

Each of the emitter outputs is first biased as shown on FIG. 10*b* with a 10 kilo-ohm resistor to circuit ground. For the ROW_1_LEFT 1064 output an associated 10 kilo-ohm resistor, 1077 is shown connected to the ANALOG_GND 1063. Further, for each photo transistor output a series 10 kilo-ohm resistor is used to provide current limiting to protect the input of the microcomputer to be described below. For the ROW_1_LEFT 1064 output the associated series 10 kilo-ohm resistor, 1074 is shown as connected to AN0, 1067 which is connected directly to microcomputer 1080 as shown on FIG. 10*c*. Each output of each photo transistor is similarly shown connected to the microcomputer 1080.

Figure 10C:
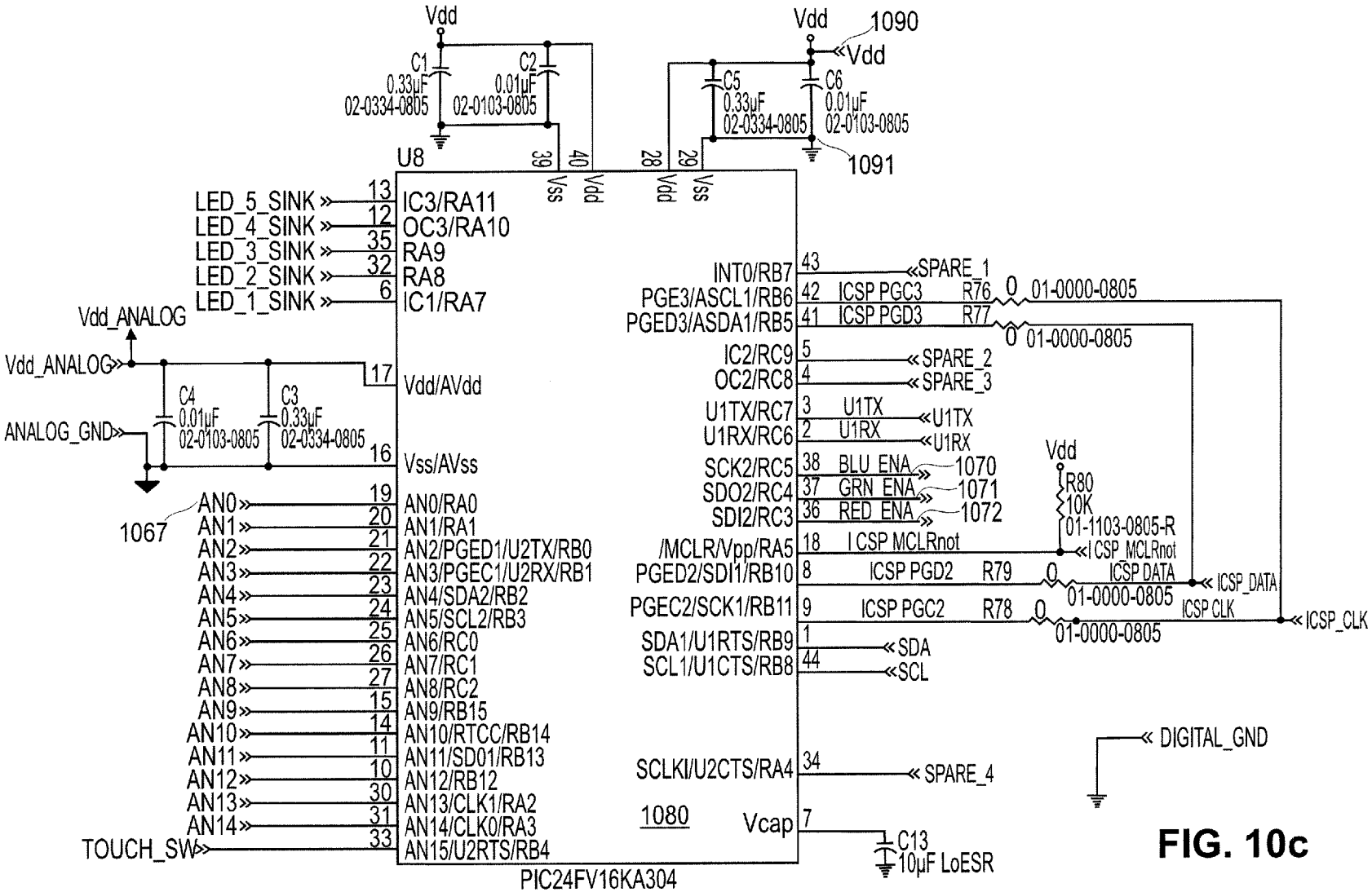
FIG. 10*c* is a schematic of a microcomputer circuit used in conjunction with the rolled coin sensing circuitry.

Each sensor board contains a microcomputer 1080 as shown on the schematic in FIG. 10*c* in a preferred embodiment of the current invention. The preferred microcomputer is a MicroChip PIC24FV16KA304. Other microcomputers with similar resources can be suitably used. Each of the phototransistor outputs modified as described above is electrically connected to analog input pins of this microcomputer. It should be clear that there are alternate configurations which may include additional components can be used to buffer the outputs of the phototransistors and the microcomputer, such as analog to digital converters or isolation drivers. Further, each of the LED source and sink lines that control the LED matrix described above also is connected directly to the microcomputer 1080. Again, there are alternate configurations which may include additional components such as driver chips that can be used between the LED sources and the microcomputer. Additional connections to the microcomputer provide for power and the ability to program the internal flash memory.

Figure 10D:
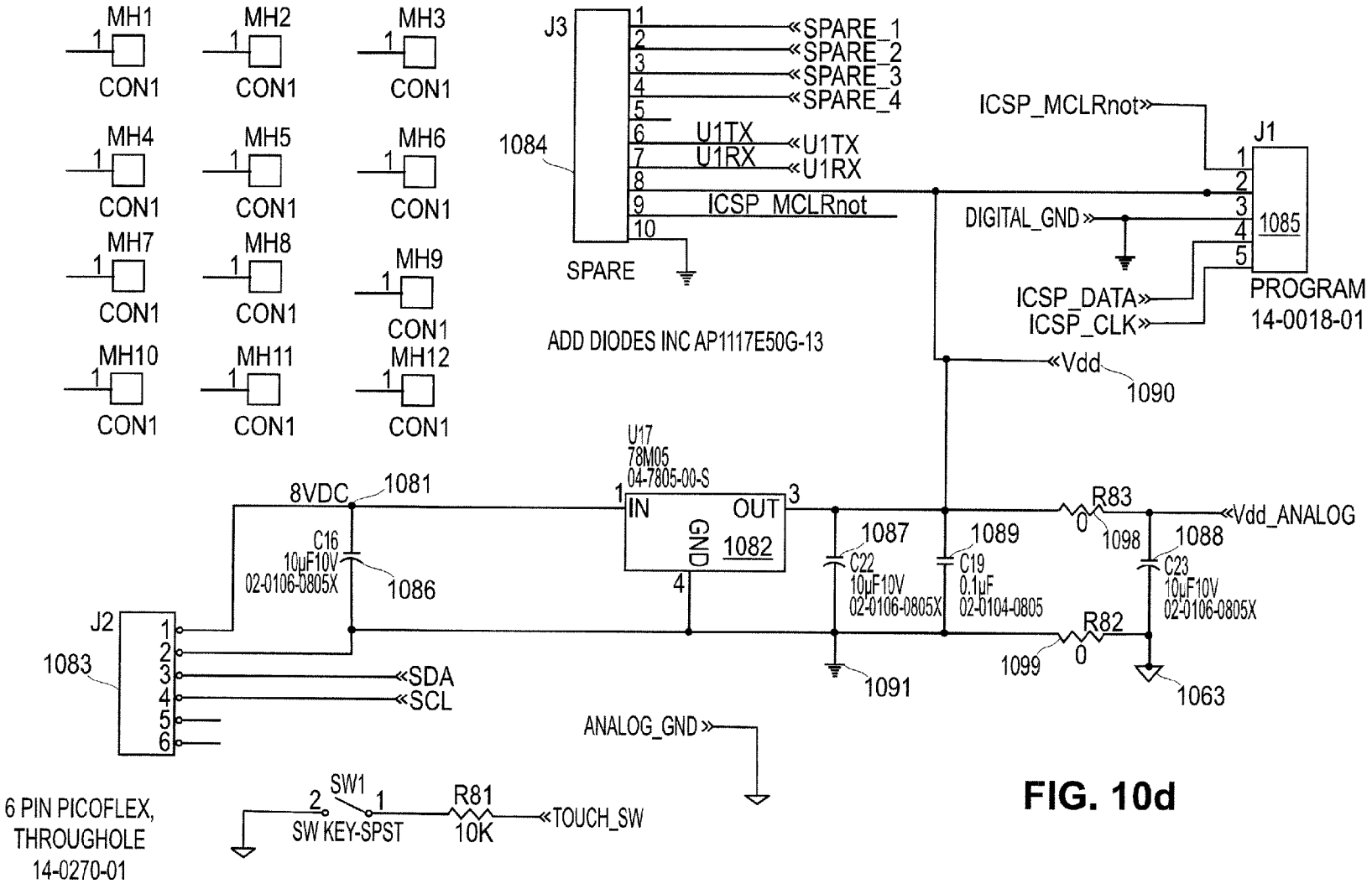
FIG. 10*d* is a schematic of a power supply circuit used in conjunction with the rolled coin sensing circuitry.

It is important, however to ensure the power to the microcomputer 1080 and the ground return for the power to the microcomputer is generally kept separate from the power and return ground used for the analog sensor signals. Referring to FIG. 10*d*, exemplary power supply circuitry is shown. In the preferred embodiment a source voltage is supplied to the sensor board through connector 1083 shown as 8 VDC, 1081 and filtered by a 10 microfarad filtering capacitor 1086. A voltage regulator 1082 is shown to generate a 5 volt source 1090 for the electronics on the sensor board. The 5 volt source voltage line 1090 and its return ground voltage line 1091 are used to power the microcomputer and other electronics directly. This voltage source is filtered by a 10 microfarad filtering capacitor 1087 to ensure the 5 volts stays constant with changing current demands. The 5 volts is also filtered by a 0.1 microfarad capacitor 1089 to filter any high frequency noise that may be present on the sensor board. Since it is particularly important that the more critical analog signals associated with the various sensors are kept free of electrical noise or unwanted influence by other components, the traces used to layout the power and return circuits on the board are kept isolated from the power to the rest of the electronics. The analog and digital 5 volts and ground circuits are electrically the same, but are shown as separated by zero ohm resistors 1098 and 1099 and with the addition of another 10 microfarad filtering capacitor 1088 to further protect the circuit board traces which are kept separate except for the one tie point back to the circuit 5 volt line 1090 and ground line 1091 at resistors 1098 and 1099.

Programming of the microcomputer 1080 is done through serial data signals through connector 1085. An additional connector 1084 is used for future options.

Figure 11:
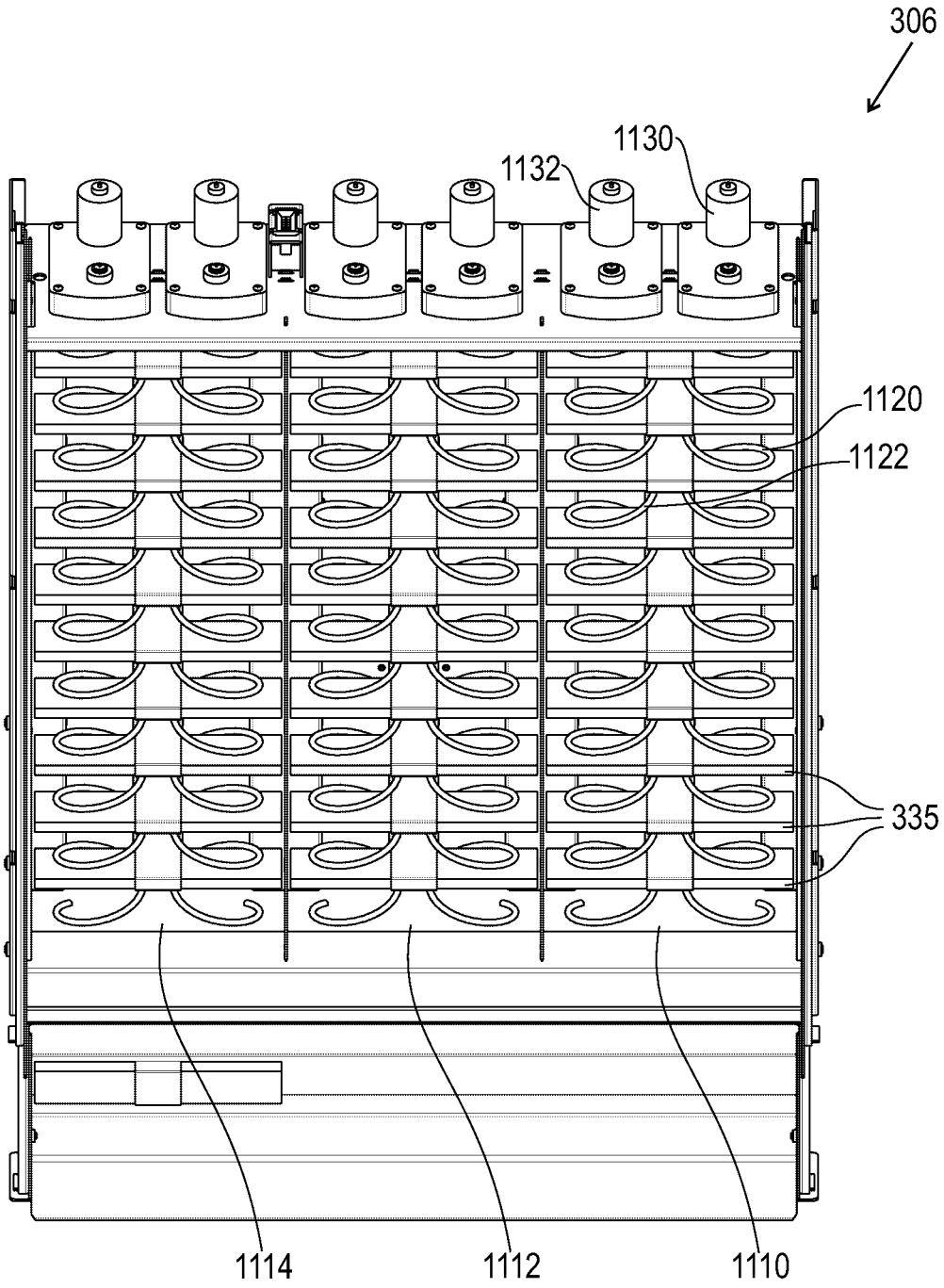
FIG. 11 is a cutout front view of a stacked bill tray with bill stacks of different bill denominations.

Referring to FIG. 11, the stack bill dispensing tray 306 can be seen setup for three columns of bill dispense channels 1110, 1112, and 1114. In the case of dispensing stacks of bills two adjacent spirals, 1120 and 1122 work synchronously to allow the proper control and dispensing action. The adjacent spirals are made in the same pitch but wound in opposite directions as can be seen by comparing spirals 1120 and 1122. The two spirals are rotated in opposite directions as well so that the motor 1130 controlling spiral 1120 will be energized to rotate in a clockwise manner at the same time as motor 1132 controlling spiral 1122 will be energized to rotate in a counterclockwise manner. This allows the stacks of bills, 335 to be transported in a fairly straight manner toward the pull drawer. Three such bill stack dispensers are shown allowing a column of $1 bills, $5 bills and $10 bills to be dispensed. Of course additional columns or trays can be used and each column can be assigned any bill type needed. Each stack of bills 335 can be of any quantity to allow a broad range of bills to be housed and dispensed by the current invention dependent on the individual site requirements. The stacks of bills can have bar coded wrappers or envelopes and use the method described above to identify each stack as they pass under the optical sensor board similar to the manner used for coins. Alternatively, each stack of bills can have an RFID tag to uniquely identify the denomination and quantity of bills in the stack. The communications to the RFID sensors mounted on the sensor boards can be encrypted to make replacing the RFID tag to "cheat" the system nearly impossible. Further, each stack of bills can be assigned a unique ID code so the reuse of ID tags would not be possible as well. The details associated with the RFID system used are described in more detail below.

It should be noted that although stacks of bills are described, the current invention is equally suited to dispense stacks of coupons, gift certificates and other similar paper or plastic sized items.

Figure 12:
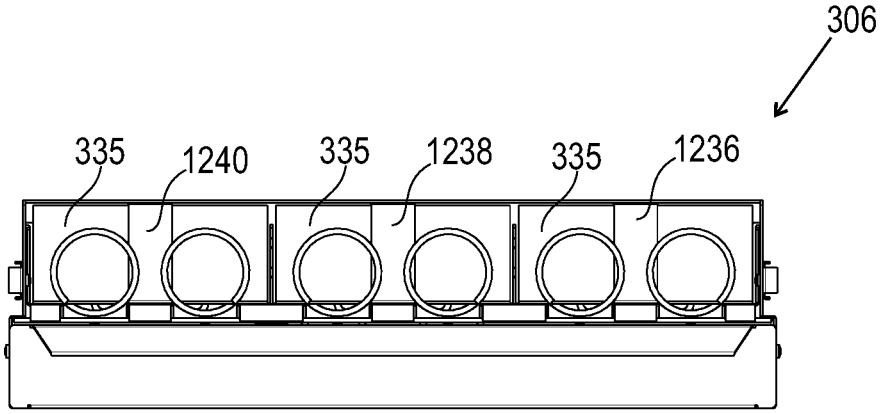
FIG. 12 shows the relative positioning of the RFID tags on a bill stack.

FIG. 12 shows a front view of the bill stack dispensing tray 306. The front most stack of bills 335 are shown with wraps 1236, 1238 and 1240 for each of three potentially different bill types. As with the coin dispenser described in detail above, as each stack of bills is moved forward, it falls into the pull drawer 180 well, shown as 220 in FIG. 2, for removal by the user. As can be seen, the use of two spirals rotating in the opposite direction holds the stack of bills relatively straight as they are dispensed. Each stack of bills can be wrapped with an RFID tag embedded in the wrapper or with a bar code printed on the wrapper. Alternatively, the stacks of bills can be placed in an envelope or shrink wrapped to further prevent handlers from stealing individual bills from the stack. In the latter case, the wrapping material would house the RFID tag or color bar codes for detection by the sensor circuits.

In order to allow the maximum flexibility relative to the number of bills in a stack the method used to identify the denomination of bills in a stack and the total value in each stack is important. The use of a color code or bar code can be used, but will allow only a limited number of variations using the techniques described above for coins. While the counting and wrapping of bills to create any number of bills in a stack is well known in the art and current equipment allows great flexibility, a suitable sensing arrangement which will also allow great flexibility is using near field noncontact sensing technology which also has the ability to allow programmable tags to be used on the stack of bills. There are a number of technologies that can be used. In a best mode implementation, RFID tags are used.

In this approach, the stack of bills will have an RFID transponder mounted in the envelope or other bill wrapper. The transponder is an integrated circuit such as the ST LRI1K from ST Microelectronics. The ID tag requires an antenna as well, but this antenna is created using a metalized ink printed in a pattern that produces a resonant inductive capacitive circuit, resonant to the operating frequency of the transponder. A typical frequency used is 13.56 MHz. Power is transmitted to the transponder through a radiated electromagnetic field from the RF transmitting and receiving device located on the sensor board 370 above the bill tray 180 shown in FIG. 3.

The RFID transponder can be programmed with a unique ID or serial number. It can additionally be programmed with the denomination of the bills in the stack, the number of bills in the stack, the date, time and location of the stack of bills. The ST LRI1K used in the current embodiment contains a 1 k bit electrically erasable programmable memory sufficient to store the needed data.

Figure 13:
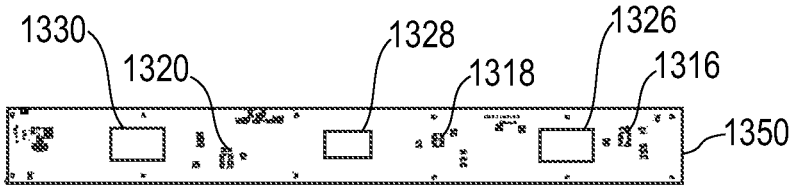
FIG. 13 is a sensor board with positioning of RFID receivers for bill stack detection.

Located on the sensor board 1350 shown in FIG. 13 are the RF transmitting and receiving devices, 1316, 1318, and 1320 used to communicate with the RFID tags described above. A preferred RF transmitting and receiving device is the TRF7960 from Texas Instruments. This device generates the RF signal, in this case, at 13.56 MHz that provides the power to the RFID transponder, as well as carries a modulated signal that communicates with the RFID transponder to read the data thereon. Also located on the sensor board are antennas 1326, 1328, and 1330 created as part of the printed circuit board layout. Each of the three bill channels will have a corresponding RF transmitting and receiving circuit. The respective transmitting and receiving devices antennas are positioned to be just above the respective RFID transponder on each stack of bills.

The system as described above has the ability to read each of the RFID tags used on each bill stack. As the bill drawer is closed, the bill stacks would be read and the inventory of bills saved. The RF transmitting and receiving device and antenna's sensing technology can read simultaneous RF tags and by virtue of the varying signal strengths received from each tag, can determine the relative positions of the bill stacks as they pass the sensor. Thus, both the stored bill values and dispensed bill values will be determined. Of course, the use of RFID tags and similar technologies can be applied to the rolled coins or rolled bills as well.

To further increase the security of the bill stack sensing system, all the communications between the sensor board and drawers can be encrypted.

Figures 1, 14A:
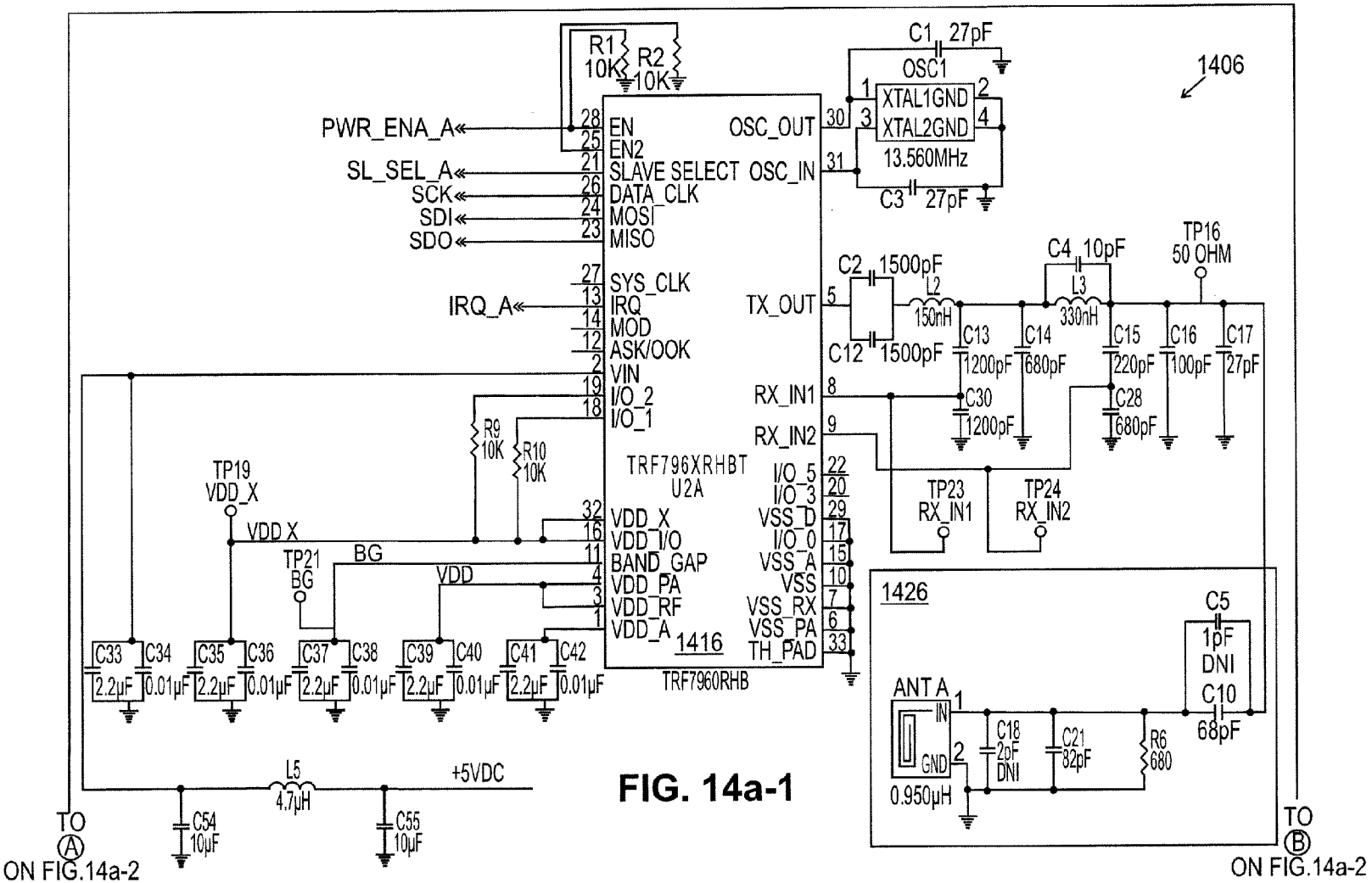
Figures 2, 14A:
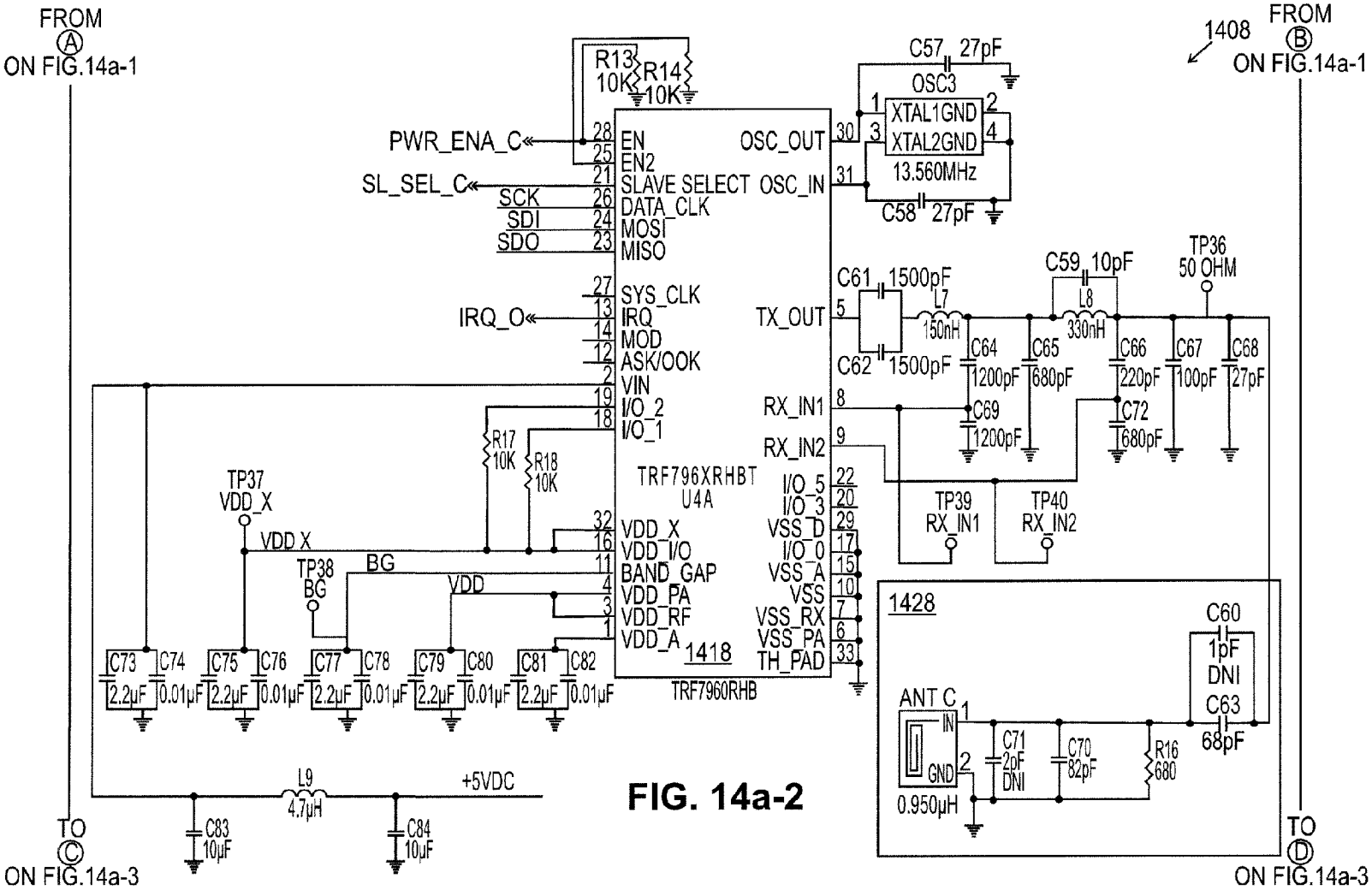
Figures 3, 14A:
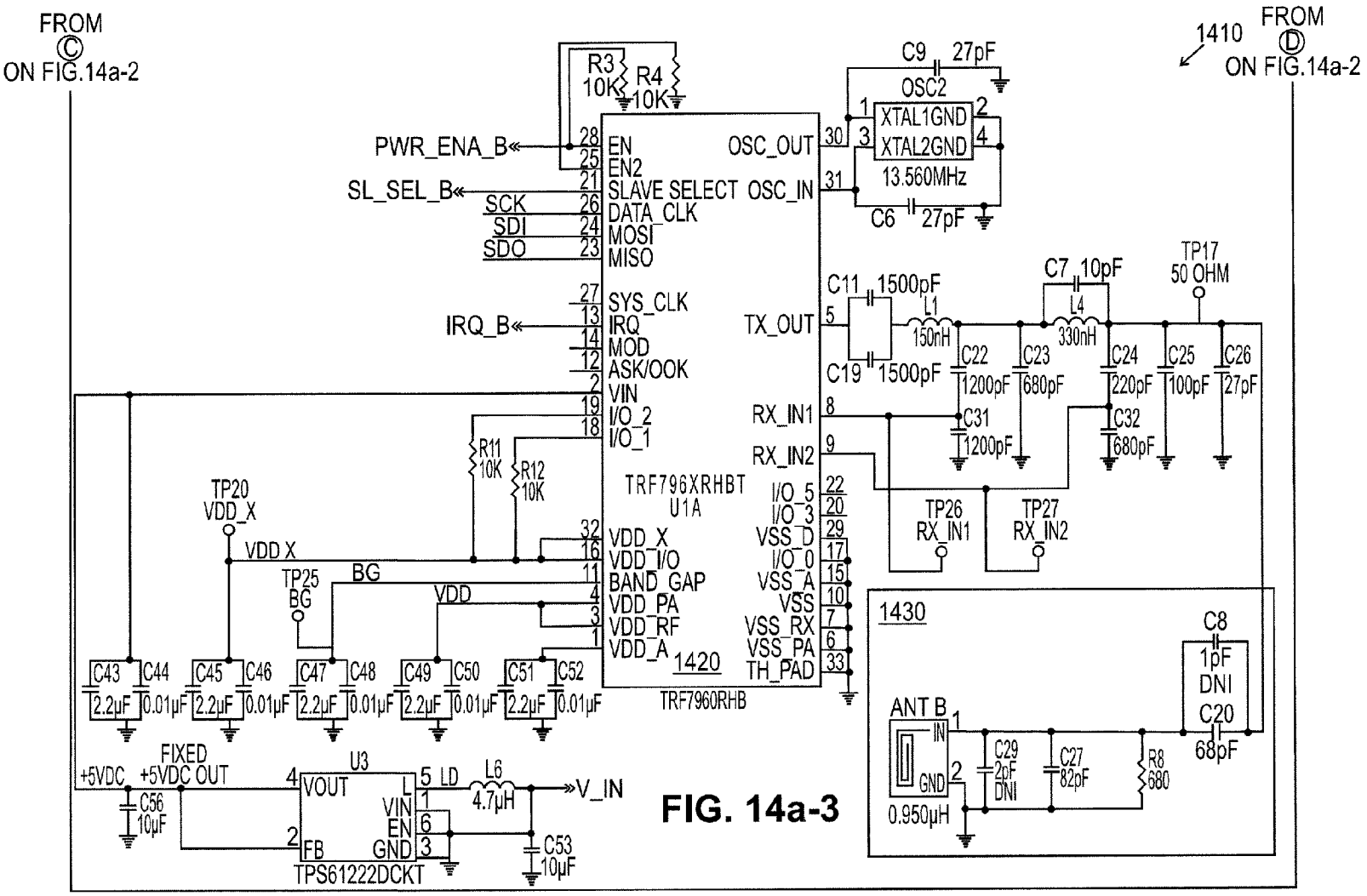

FIG. 14*a* is a schematic of the RFID transmitter and receiver circuitry 1406, 1408 and 1410 respectively used for each of the three channels of bill stacks. In a preferred embodiment, each of the transmitter and receiver circuitry includes the RF transmitting and receiving device, 1416, 1418, and 1420 respectively. In addition to the required biasing and interface circuitry required, each channel's receiver circuitry also includes an antenna, 1426, 1428, and 1430. To better describe the details of the schematic shown, the circuitry for one of the channels is shown in further detail in FIG. 14*b*.

Figure 14B:
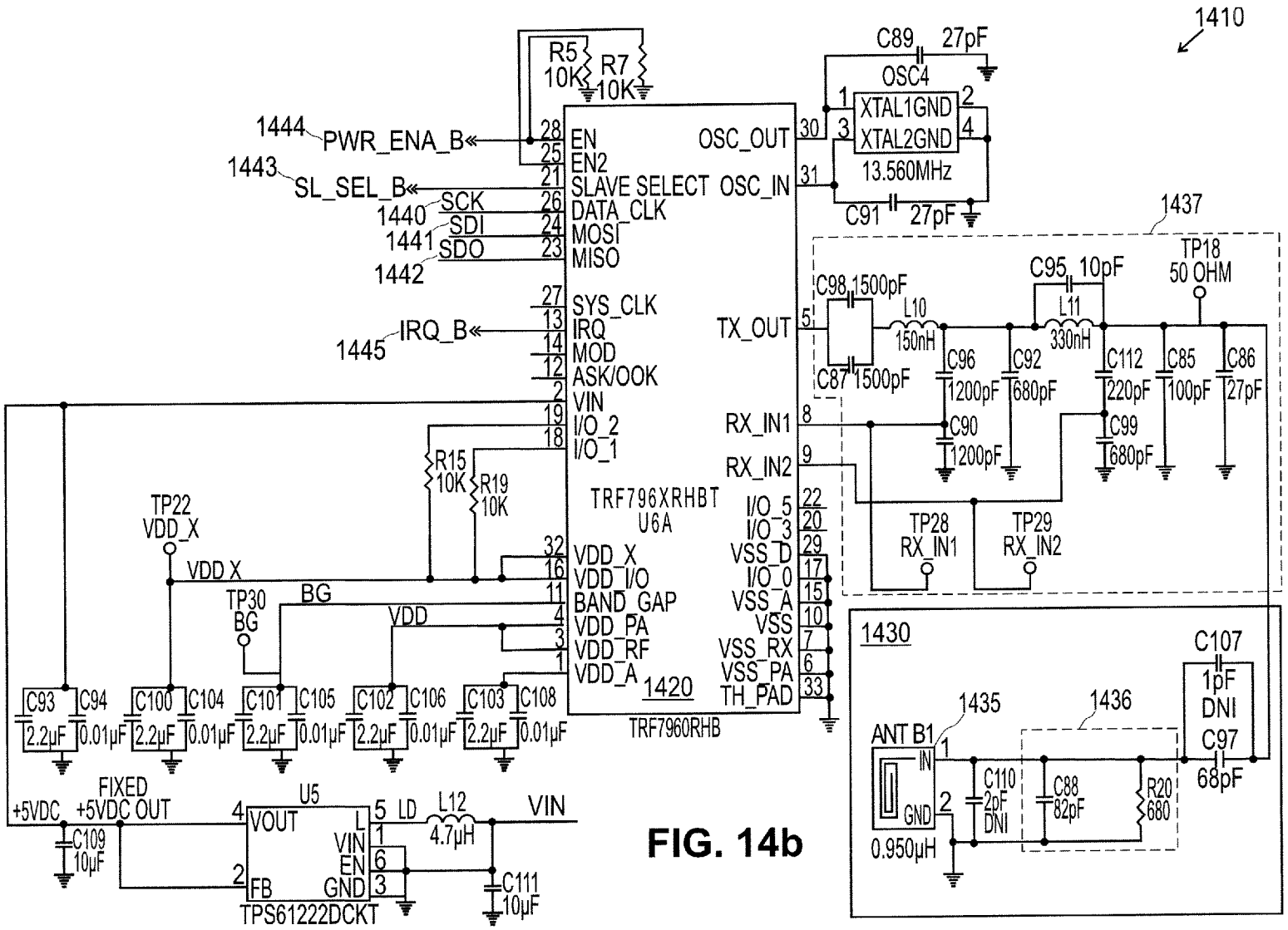
FIG. 14*b* is a schematic of one RFID bill stack circuit used in a presently preferred embodiment.

FIG. 14*b* is a schematic of one channel 1410 of the transmitter and receiver circuitry used to communicate to the RFID transponder located on the stack of bills as described above. The integrated circuit used to encode and decode the data being sent and received to the transponder is the TRF7960 from Texas Instruments as described above. The details of operation of this component can be found in the specifications provided by the manufacturer and is not described in detail here. Of course, there are a number of alternate integrated circuits that can be used as will be understood by one skilled in the art.

In the current embodiment, the transmitter and receiver integrated circuit 1410 is in communication with a microcomputer, through an industry standard communications protocol known as an SPI bus. Specifically, the SPI bus consists of three communication signals including the SCK or clock 1440, the SDI or data input line 1441 and the SDO or data output line 1442. In addition, the transmitter and receiver integrated circuit 1410 has a number of control signals 1443 including the SL_SEL_B used to select the SPI bus specific to this circuit channel 1444 the PVR_ENA_B or power enable signal and the IRQ_B, or interrupt request signal 1445 used to indicate to the microcomputer that there is data ready to be received.

The transmitter and receiver integrated circuit 1410 sends and receives RF signals to the corresponding transducer on the bill stacks through the use of an antenna 1430 designed as a printed circuit board layout configuration 1435. Various filtering components 1436 and 1437 are used to preprocess the signals going to and from the antenna as recommended by the manufacturer.

Figure 14C:
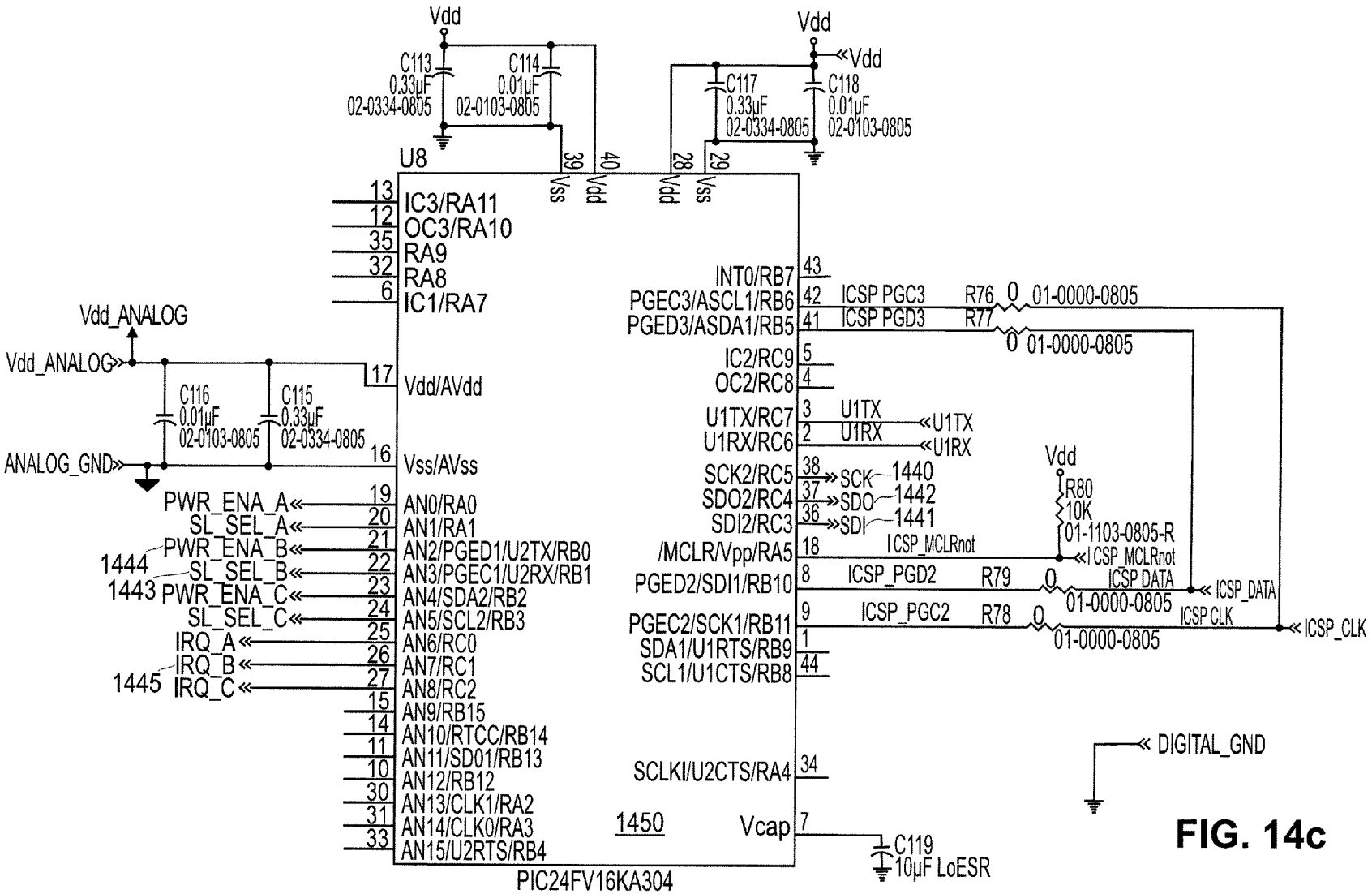
FIG. 14*c* is a schematic of a microcomputer circuit used in conjunction with the RFID bill stack sensing circuitry.

Referring now to FIG. 14*c*, the schematic of the microcomputer 1450 and its interconnections are shown. The microcomputer 1450 used in the presently preferred embodiment is a PIC24FV16KA304 manufactured by Microchip. It should be understood that there are many choices of microcomputer suitable for this application and any of these can be used. The signals described above constituting the communications between the transmit and receiver integrated circuit of FIG. 14*b* can be seen for the SPI bus connections to the microcomputer 1450 on signals SCK 1440, SDI 1441, and SDO 1442. Additionally, the control signals described above can also be seen interconnected to the microcomputer 1450 in signals SL_SEL_B 1443, PWR_ENA_B 1444 and IRQ_B 1445. Other signals not described include the signals required to program the program memory contained in the microcomputer as well as power and ground signals.

The coin and bill dispensing safe of the current invention advantageously tracks the number of rolls of coins and stacks of bills as well as their value both when the money is placed in the safe as well as when it is dispensed from the safe. In a preferred embodiment, the number of rolls of each coin type as well as the amount of bills and number of bill stacks for each bill type is matched with the requirements of the specific facilities' needs that the safe services. If the facility needs to withdraw $50 worth of $1 bills routinely, the bill stack can be made as 50, $1 bills. The user would then insert $50 in any combination of bills to the bill acceptor or acceptors and select one stack of $1 bills to be dispensed. In the case that the amount of money deposited in the bill acceptors is solely for the purpose of buying rolls of coins or stacks of bills, the system is closed loop and the amount of money in the safe is a constant. This closed loop approach is a significant advantage to a service provider wanting to sell coins and small bills within a location without having to deliver money on a daily basis. The change required would be stored in the safe for a predetermined amount of time, such as a week. The service provider would reduce the number of money deliveries required while the facility will have access to the change needed. The safe can further be provided with various communications means to allow it to call the service provider when the number of rolls of coins or stacks of bills is running low allowing the service provider to optimize the number of deliveries needed.

The current invention also allows the service provider to communicate in advance with the safe to let it know the number of rolls of coins and stacks of bills the delivery person will be inserting in the safe. When the delivery person arrives to fill the safe, the total money inserted can be matched with the previously communicated amount and an alarm sent if they do not match. A message can also be displayed on the display to indicate a discrepancy. An authorizing code can be sent to allow the discrepancy to be accepted, the machine to be disabled, or any other action taken which is deemed to be appropriate.

Another embodiment of the current invention would be to add a fixed or percent fee to buy coins or bills and add it to the amount needed to be inserted into the bill validators to buy the desired coins and bills.

Additionally, a minimum "purchase" amount can be set, forcing for example a minimum of at least two rolls of pennies at a time.

Another embodiment of the current invention would allow a user to deposit an amount of money into the safe through the bill acceptors and be given a menu of options for rolls of coins or stacks of bills to be dispensed. A simplified example is if $10 is deposited into the bill acceptor, the display could show the option of selecting a roll of quarters or two rolls of dimes, five rolls of nickels, or twenty rolls of pennies. If one roll of dimes is selected, the menu will then be able to show that one additional roll of dimes, two rolls of nickels and two rolls of pennies may be dispensed. Of course the options can be as broad as all possibilities or limited to one or two denomination types. This approach allows a user to avoid having to do any calculations to quickly replenish his or her cash drawer.

The current invention also anticipates using the coin and bill dispensing safe as described above in one of the several configurations described and additionally as an electronic smart drop safe with the independent functionality of a drop safe, tracking bills accepted independently of any coins or bills stacked. This approach allows the combination of a dispensing safe and a drop safe to be realized with a single electronic safe.

It will be clear that there are numerous configurations and embodiments possible using the technology and techniques described above. While the present invention is disclosed in the context of presently preferred embodiments, it will be recognized that a wide variety of implementations may be employed by persons of ordinary skill in the art consistent with the above discussion and the claims which follow below.

We claim:

1. An item dispensing system comprising:

a dispensing unit to dispense items comprising:

a first storage unit storing items in columns;

a first drive assembly for controllably advancing the items in each column until a front most item is delivered from the first storage unit to a customer retrieval area;

an access door;

a lock to allow the access door to be opened or securely closed;

a sensor arrangement to detect all items stored in the first storage unit each time items are added to the first storage unit, the sensor arrangement also detecting each time the front most item is delivered from the first storage unit to the customer retrieval area; and a controller controlling the first drive assembly and maintaining a dynamic count of all the items in the first storage unit based upon outputs from the sensor arrangement.

2. The item dispensing system of claim 1 wherein the items comprise stacks of bills each stack including a wrapper having a detectable indicium thereon.

3. The item dispensing system of claim 1 wherein the items comprise rolls of coins each roll having a wrapper with a detectable indicium thereon.

4. The item dispensing system of claim 1 further comprising:

a bill acceptor to accept one or more denominations of bills to pay for dispensed items, the controller receiving inputs from the bill acceptor and processing said received inputs and the outputs from the sensor arrangement to provide a closed loop money accounting system.

5. The cash dispensing system of claim 4, wherein the controller receives inputs from the sensor mechanism and the bill acceptor to control the first drive assembly to dispense an item or items corresponding in value to a value corresponding to the bill or bills inserted in the bill acceptor.

6. The item dispensing system of claim 1, wherein the controller receives inputs from the sensor mechanism when the first storage unit is closed after stocking, and dynamically tracks an inventory of items in the first storage unit.

7. The item dispensing system of claim 6, wherein the controller predicts future restocking needs based upon monitoring current usage.

8. The item dispensing system of claim 1 further comprising:

a safe enclosure; and wherein said items comprise rolls of coins, rolls of bills or stacks of bills.

9. The item dispensing system of claim 8 wherein the controller is programmed to anticipate a number and value of rolls or stacks to be loaded and to send alerts.

10. The item dispensing system at claim 8 further comprising:

a bill validator;

a display, and wherein a dynamically updated list of options for currency dispensing is displayed based on a value of money deposited in the bill validator.

11. The item dispensing system of claim 1 wherein a communication is received to communicate a value of items that will be inserted in the storage unit by a service person, the sensor unit detects a value when items are stored in the storage unit by the service person, and the controller controls a display to display a message if the communicated value of items does not match the detected value to indicate a discrepancy.

12. The item dispensing system of claim 1 wherein the items comprise stacks of bills, each stack including a wrapper having a detectable indicia.

13. The item dispensing system of claim 1 wherein the sensor arrangement sends data to the controller indicative of the value of the items being dispensed.

14. An item dispensing system comprising:

a dispensing unit to dispense items comprising:

a first storage unit storing items in columns;

a first drive assembly for controllably advancing the items in each column until a front most item is delivered from the first storage unit to a customer retrieval area;

an access door;

a lock to allow the access door to be opened or securely closed;

a sensor arrangement to detect when items are stored in the first storage unit, the sensor arrangement also detecting when the front most item is delivered from the first storage unit to the customer retrieval area; and a controller controlling the first drive assembly and maintaining a dynamic count of the items in the first storage unit based upon outputs from the sensor arrangement, wherein the first storage unit further comprises:

a slideable tray which when slid open allows an authorized user to readily restock the first storage unit with items.

15. An item dispensing system comprising:

a dispensing unit to dispense items comprising:

a first storage unit storing items in columns;

a first drive assembly for controllably advancing the items in each column until a front most item is delivered from the first storage unit to a customer retrieval area;

an access door;

a lock to allow the access door to be opened or securely closed;

a sensor arrangement to detect when items are stored in the first storage unit, the sensor arrangement also detecting when the front most item is delivered from the first storage unit to the customer retrieval area; and a controller controlling the first drive assembly and maintaining a dynamic count of the items in the first storage unit based upon outputs from the sensor arrangement, wherein the storage unit further comprises a first tray which slides on sliders to slideably extend the first tray outwardly when the access door is open to facilitate restocking.

16. The item dispensing system of claim 15 wherein when the first tray is slideably extended, all items stored in the first tray pass a sensor of the sensor arrangement, and as the first tray is slideably returned fully inside the dispensing system, whereby all items in the first tray again pass the sensor.

* * * * *